US012172860B2

(12) United States Patent
Furukawa

(10) Patent No.: US 12,172,860 B2
(45) Date of Patent: Dec. 24, 2024

(54) SHEET PROCESSING DEVICE AND IMAGE FORMING SYSTEM

(71) Applicant: CANON KABUSHIKI KAISHA, Tokyo (JP)

(72) Inventor: Hitoshi Furukawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/162,058

(22) Filed: Jan. 31, 2023

(65) Prior Publication Data

US 2023/0264920 A1 Aug. 24, 2023

(30) Foreign Application Priority Data

Feb. 21, 2022 (JP) ..... 2022-024515

(51) Int. Cl.
*B65H 31/00* (2006.01)
*B65H 43/00* (2006.01)

(52) U.S. Cl.
CPC ..... *B65H 43/00* (2013.01); *B65H 31/00* (2013.01); *B65H 2301/152* (2013.01); *B65H 2511/11* (2013.01)

(58) Field of Classification Search
CPC ..... B65H 2301/152; B65H 31/00; B65H 2511/11
See application file for complete search history.

(56) References Cited

U.S. PATENT DOCUMENTS

| | | | | |
|---|---|---|---|---|
| 10,189,664 | B1 * | 1/2019 | Taki | B65H 31/34 |
| 11,336,786 | B2 | 5/2022 | Furukawa et al. | |
| 2017/0101285 | A1 * | 4/2017 | Ishihara | B65H 31/36 |
| 2017/0242388 | A1 * | 8/2017 | Matsuno | B65H 31/02 |

FOREIGN PATENT DOCUMENTS

| | | | |
|---|---|---|---|
| JP | 2001-287846 | A | 10/2001 |
| JP | 2015-000785 | A | 1/2015 |
| JP | 2021-088462 | A | 6/2021 |
| JP | 2021-095291 | A | 6/2021 |

* cited by examiner

*Primary Examiner* — Jennifer Bahls
(74) *Attorney, Agent, or Firm* — Venable LLP

(57) ABSTRACT

A sheet processing device includes a stacking member configured to stack a sheet, a discharging member configured to discharge the sheet stacked on the stacking member, a discharging tray on which the sheet discharged by the discharging member is stacked, a pushing-out member configured to push out the sheet from the stacking member toward the discharging member by being moved in a pushing-out direction, and a controller configured to select, on the basis of information of the sheet stacked on the stacking member, whether to move the pushing-out member to which position of a first position and a second position positioned on a side downstream of the first position with respect to the pushing-out direction.

10 Claims, 13 Drawing Sheets

(a)

(b)

(a)

(b)

(c)

SHEET PROCESSING DEVICE AND IMAGE FORMING SYSTEM

FIELD OF THE INVENTION AND RELATED ART

The present invention relates to a sheet processing device for processing a sheet and an image forming system for forming an image on the sheet.

As an option of an image forming apparatus which is, for example, an electrophotographic multi-function machine, a sheet processing device in which the sheet on which the image is formed in an image forming apparatus main assembly is subjected to processing such as binding processing or sort processing is used. For example, in Japanese Laid-Open Patent Application (JP-A) 2021-095291, a post-processing device in which sheets fed to a processing tray of a sheet processing device are subjected to the binding processing and then are stacked on a discharge tray is disclosed. In this post-processing device, a discharge guide is slid and moved to push out the sheets from the processing tray and the pushed-out sheets are received by a feeding roller pair, and then the sheets are stacked on the discharge tray by rotationally driving a discharging roller pair.

As in the case of the feeding roller pair in a conventional technique, as regards sheet feeding by rollers, there is a possibility that the sheet is obliquely moved by a slip thereof or the like. When the sheets are stacked in a state in which the sheets are obliquely moved, this has the influence on an alignment state of the sheets on the discharge tray. For this reason, it is required that the alignment state of the sheets stacked on the discharge tray is improved by reducing a degree of the oblique movement of the fed sheets.

SUMMARY OF THE INVENTION

The present invention has been accomplished in view of these circumstances. A principal object of the present invention is to provide a sheet processing device and an image forming system which are capable of improving an alignment state of recording materials stacked on a discharge tray by reducing a degree of oblique movement of the recording materials fed to the discharge tray.

According to an aspect of the present invention, there is provided a sheet processing device comprising: a stacking member configured to stack a sheet; a discharging member configured to discharge the sheet stacked on the stacking member; a discharging tray on which the sheet discharged by the discharging member is stacked; a pushing-out member configured to push out the sheet from the stacking member toward the discharging member by being moved in a pushing-out direction; and a controller configured to select, on the basis of information of the sheet stacked on the stacking member, whether to move the pushing-out member to which position of a first position and a second position positioned on a side downstream of the first position with respect to the pushing-out direction.

According to another aspect of the present invention, there is provided an image forming system comprising: an image forming apparatus configured to form an image on a sheet; and a sheet processing device according to claim 1, wherein the sheet processing device receives the sheet from the image forming apparatus and subjects the received sheet to predetermined processing.

Further features of the present invention will become apparent from the following description of exemplary embodiments with reference to the attached drawings.

Figure 2:
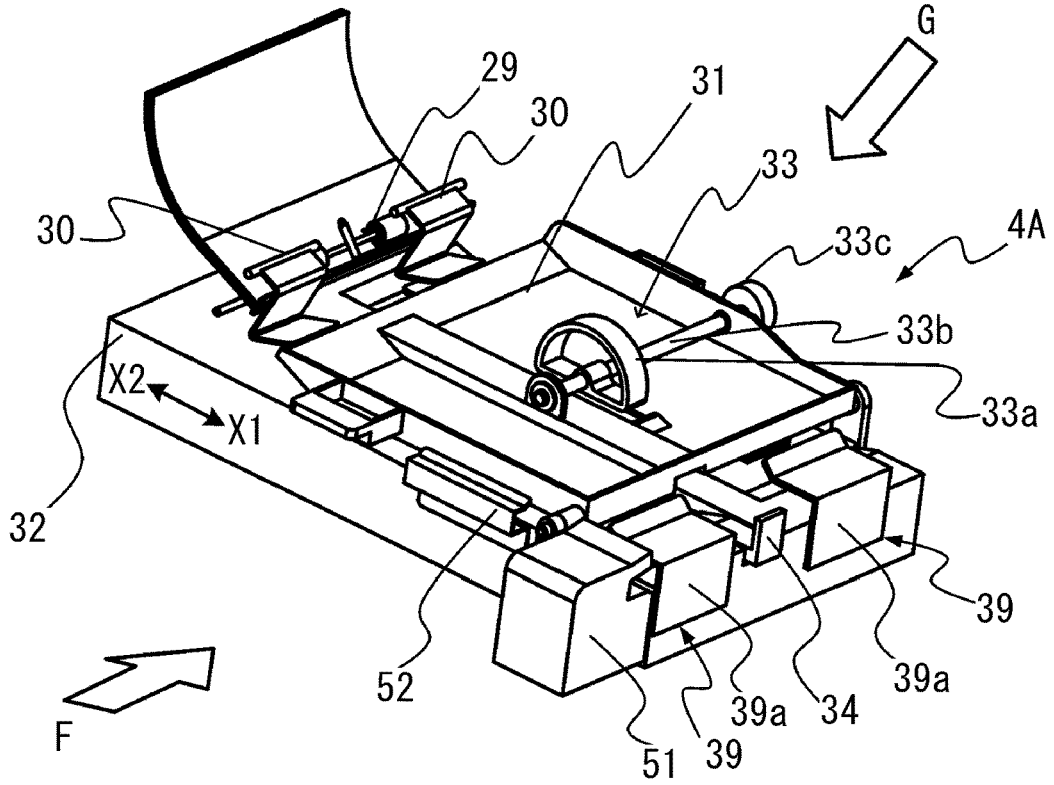
Figure 2:
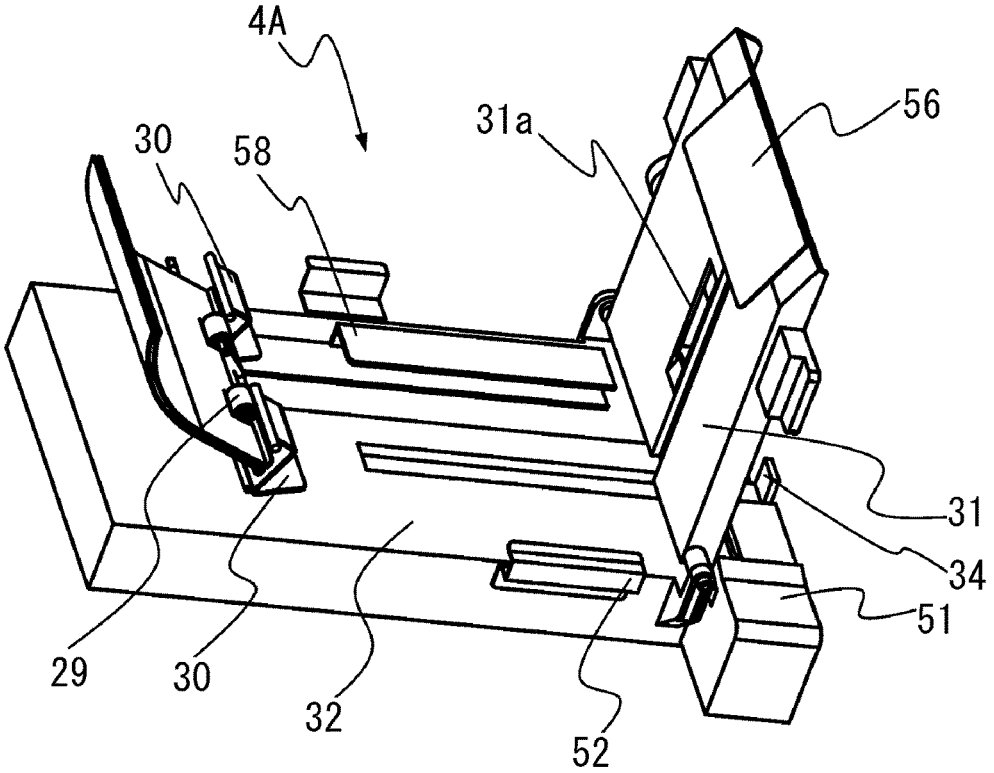

Parts (a) and (b) of FIG. 2 are perspective views of a binding processing portion in the embodiments 1 and 2.

Figure 3:
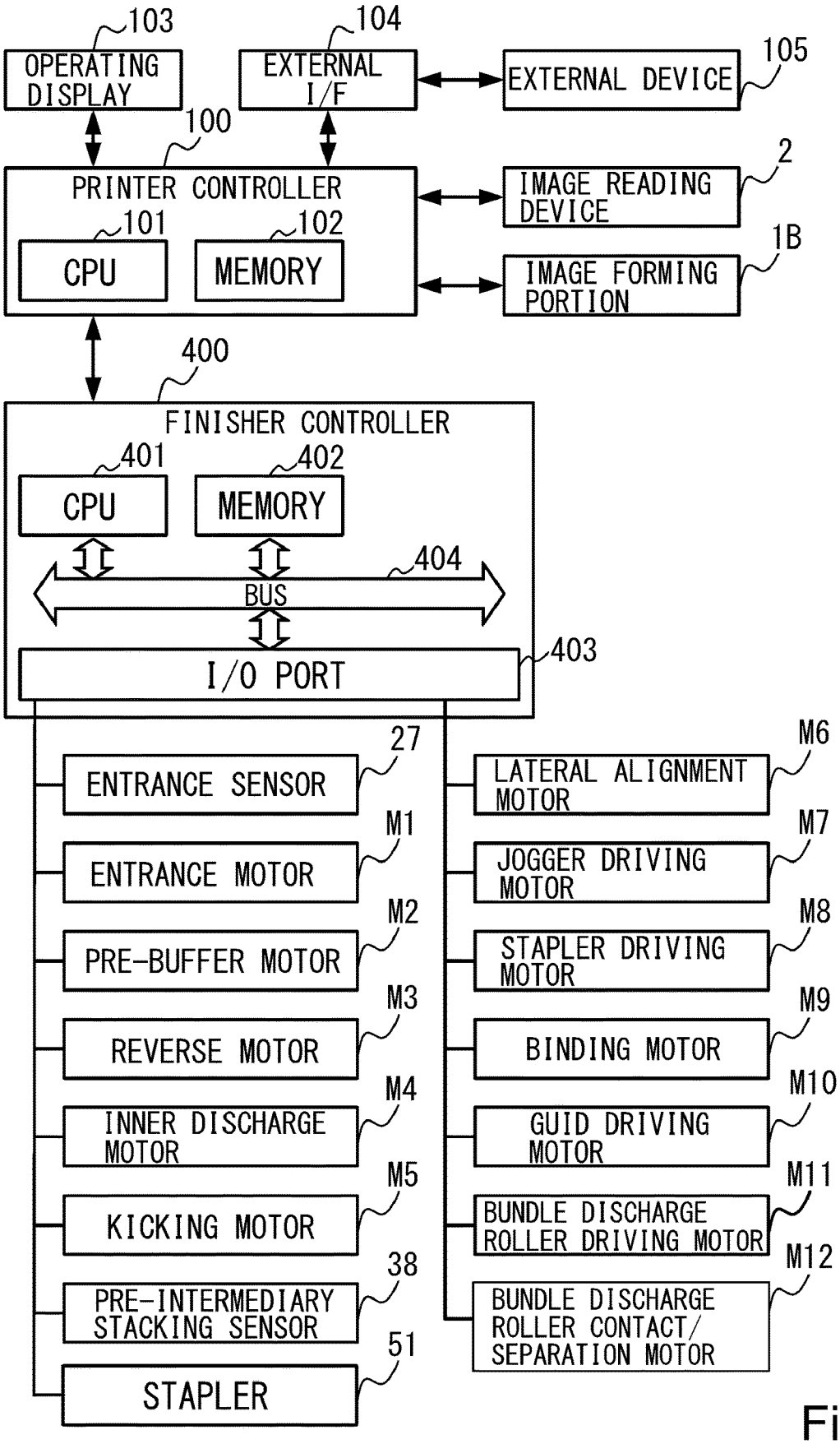

FIG. 3 is a hardware constitution diagram of the image forming system of the embodiments 1 and 2.

Figure 4:
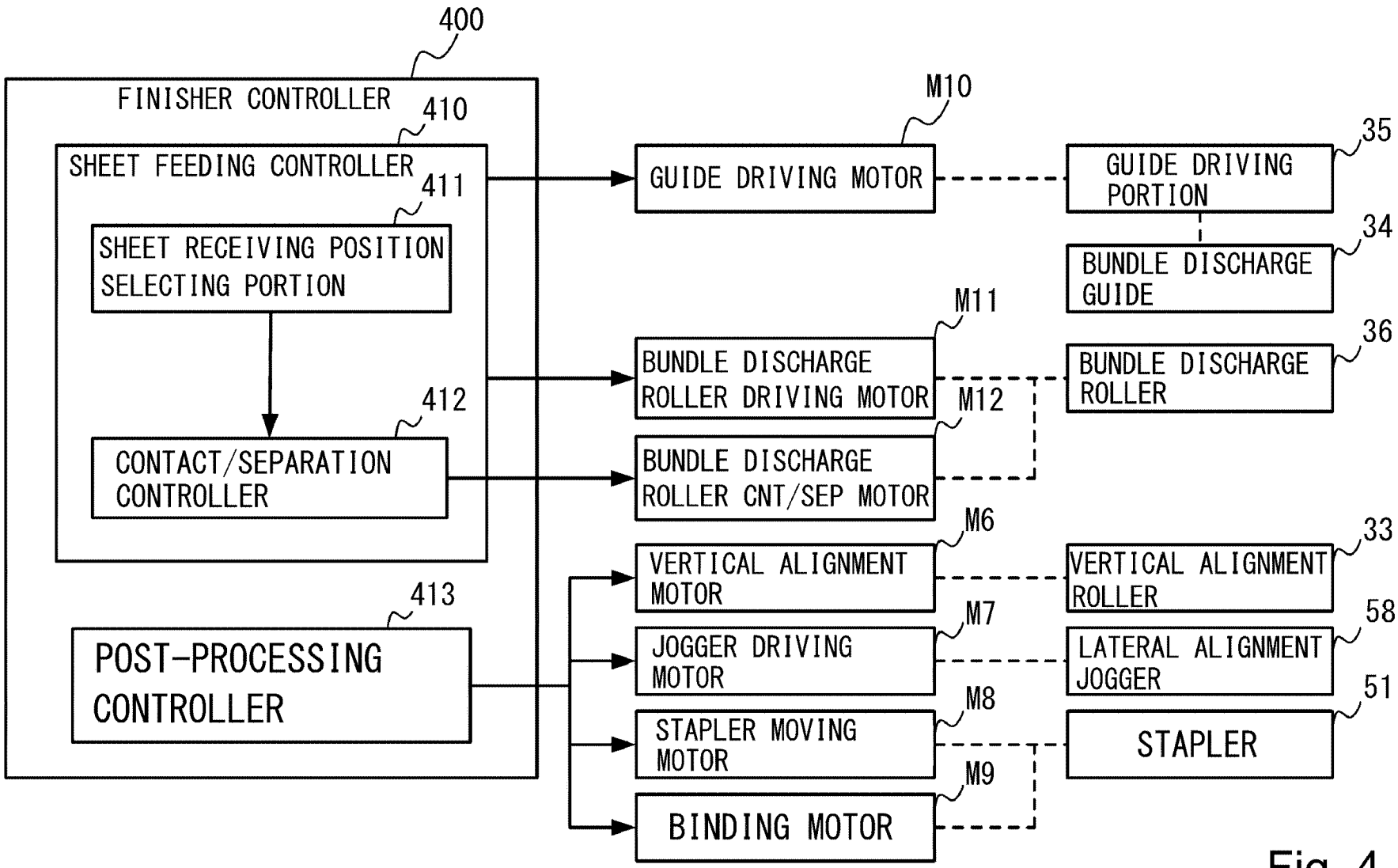

FIG. 4 is a function block diagram of the image forming system of the embodiment 1.

Figure 5:
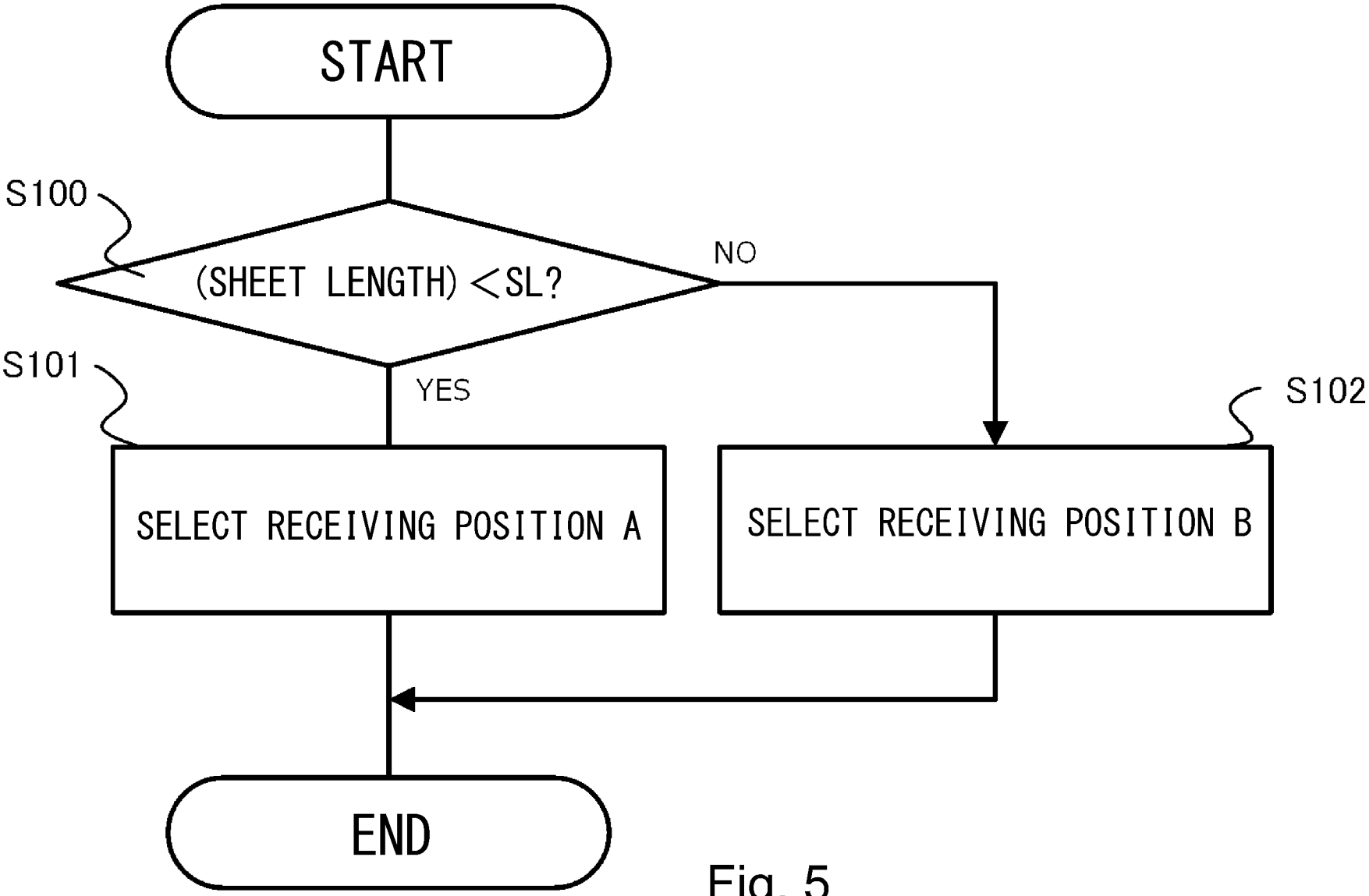

FIG. 5 is a flowchart showing processing of a sheet receiving position selecting portion in the embodiment 1.

Figure 6:
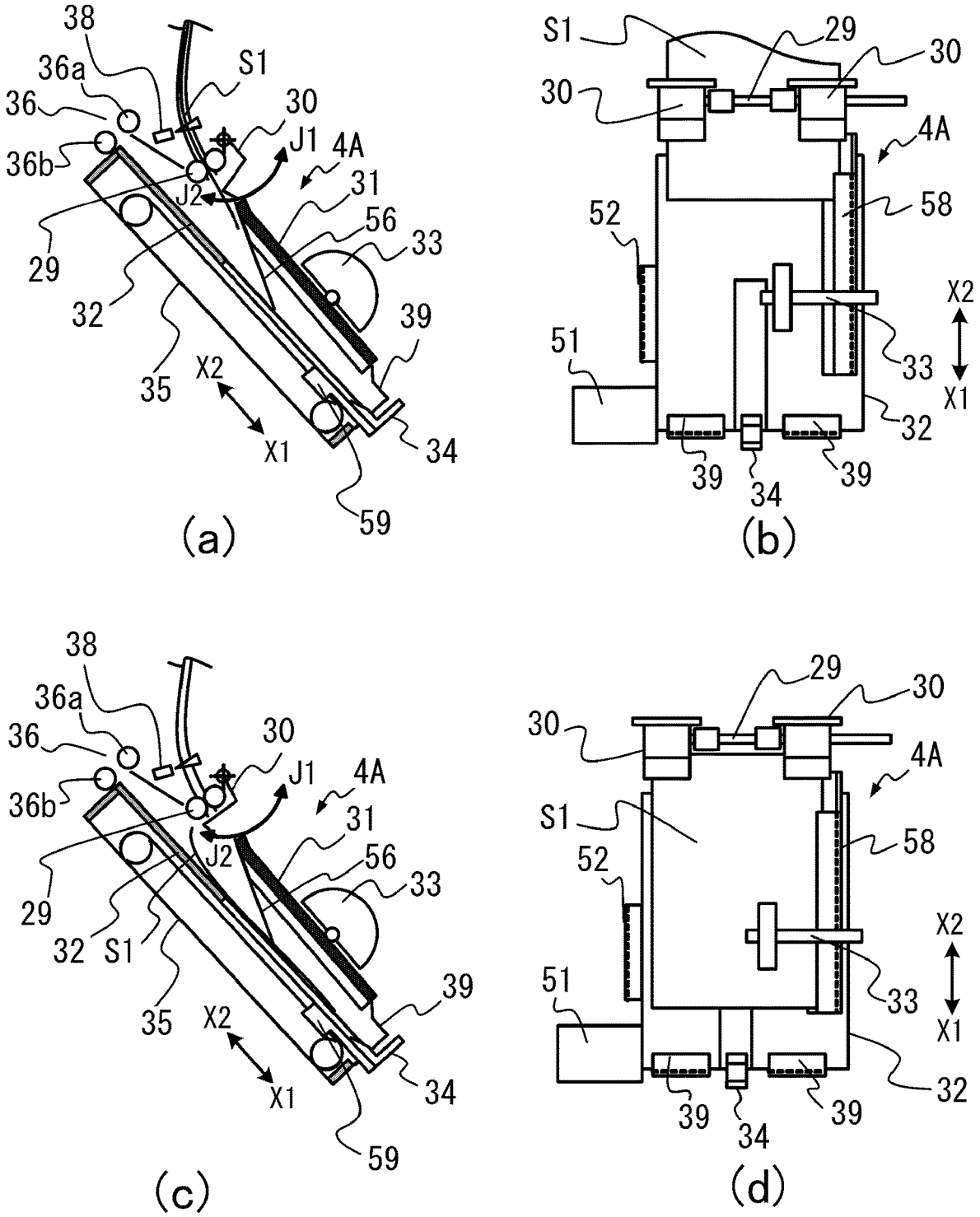

Parts (a) to (d) of FIG. 6 are schematic views for illustrating an operation of the binding processing portion in the embodiment 1.

Figure 7:
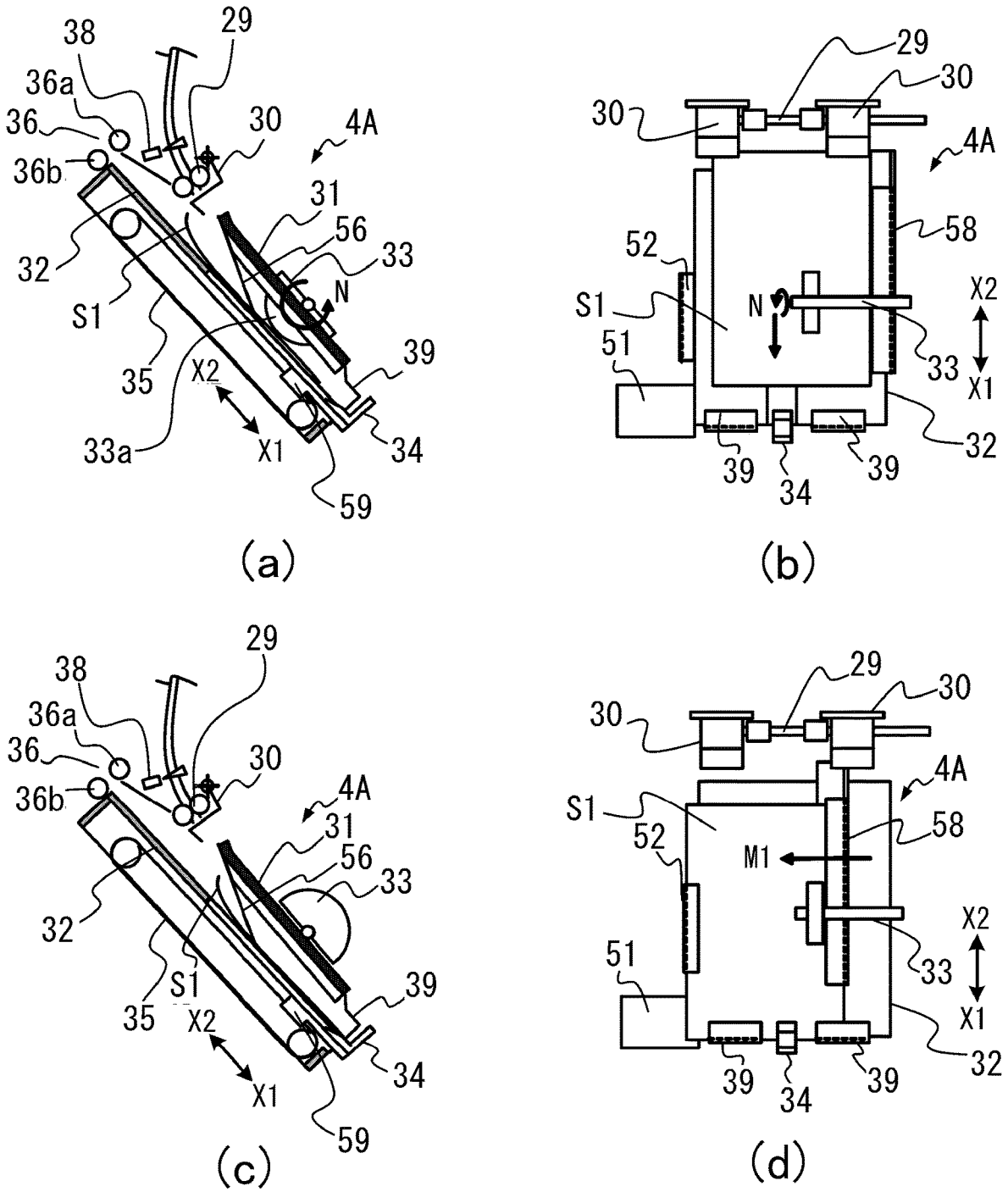

Parts (a) to (d) of FIG. 7 are schematic views for illustrating the operation of the binding processing portion in the embodiment 1.

Figure 8:
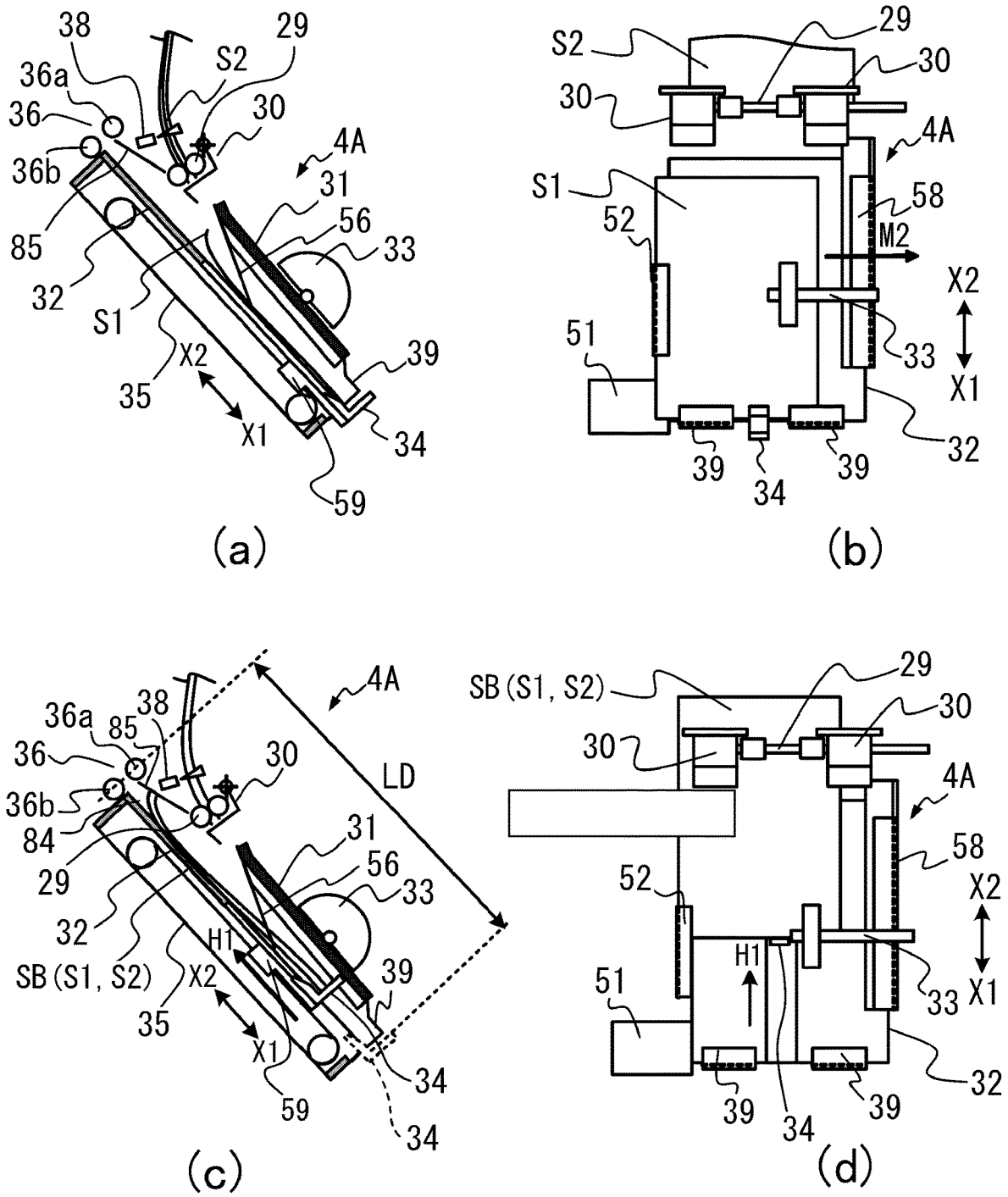

Parts (a) to (d) of FIG. 8 are schematic views for illustrating the operation of the binding processing portion in the embodiment 1.

Figure 9:
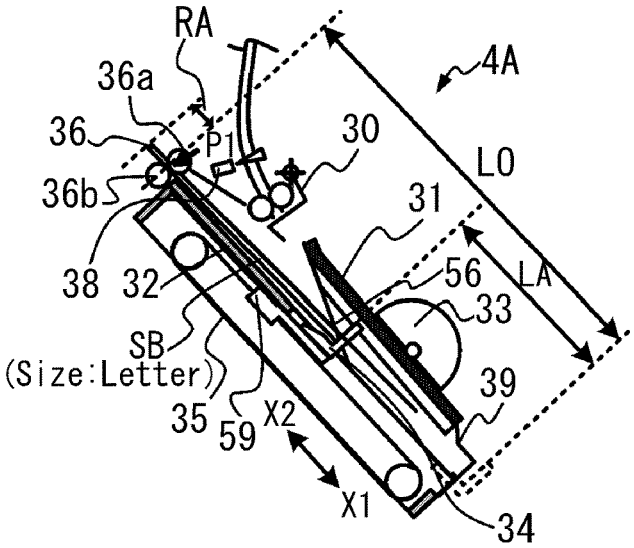
Figure 9:
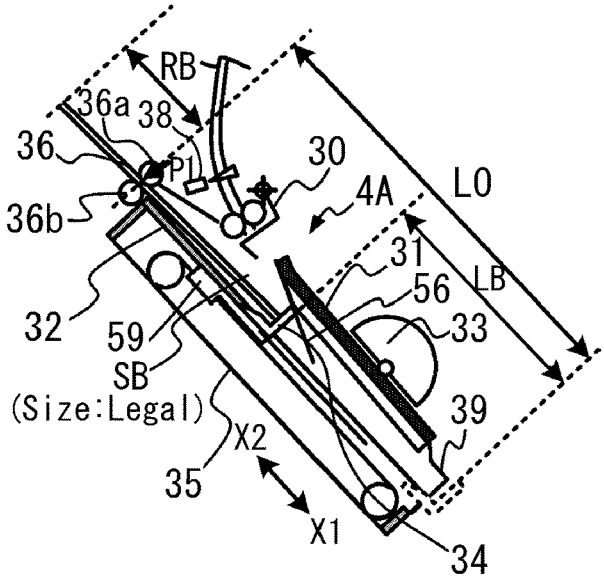
Figure 9:
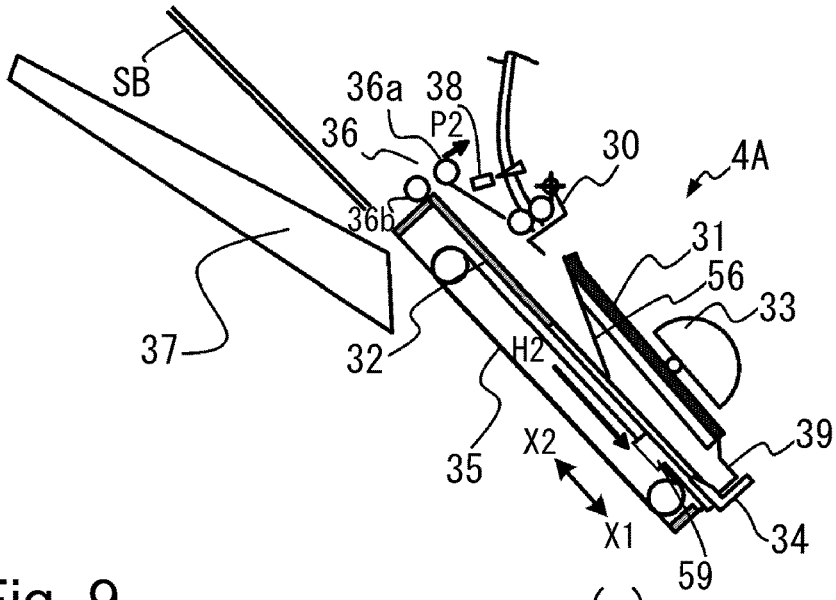

Parts (a) to (c) of FIG. 9 are schematic views for illustrating the operation of the binding processing portion in the embodiment 1.

Figure 10:
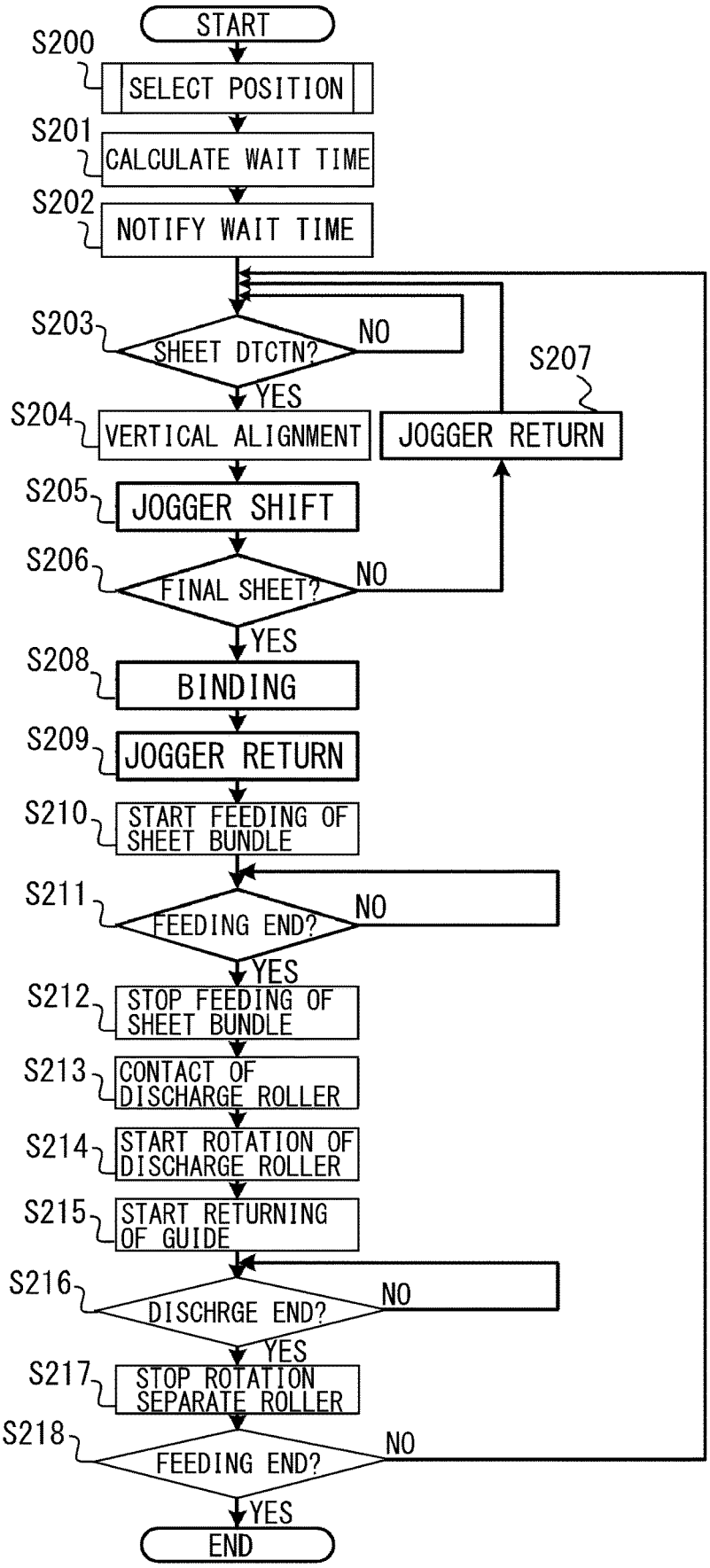

FIG. 10 is a flowchart showing operation processing of the binding processing portion in the embodiment 1.

Figure 11:
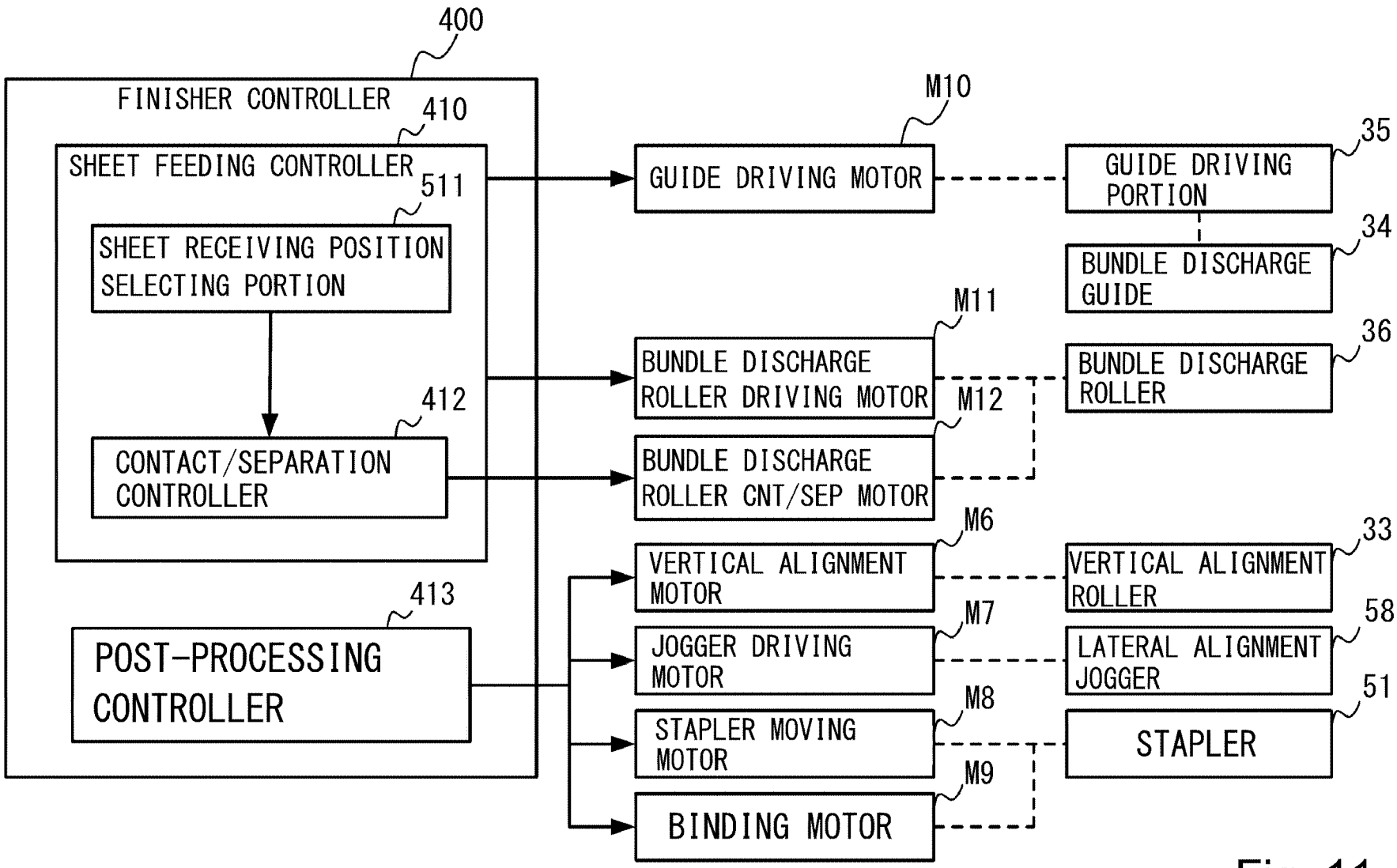

FIG. 11 is a function block diagram of the image forming system of the embodiment 2.

Figure 12:
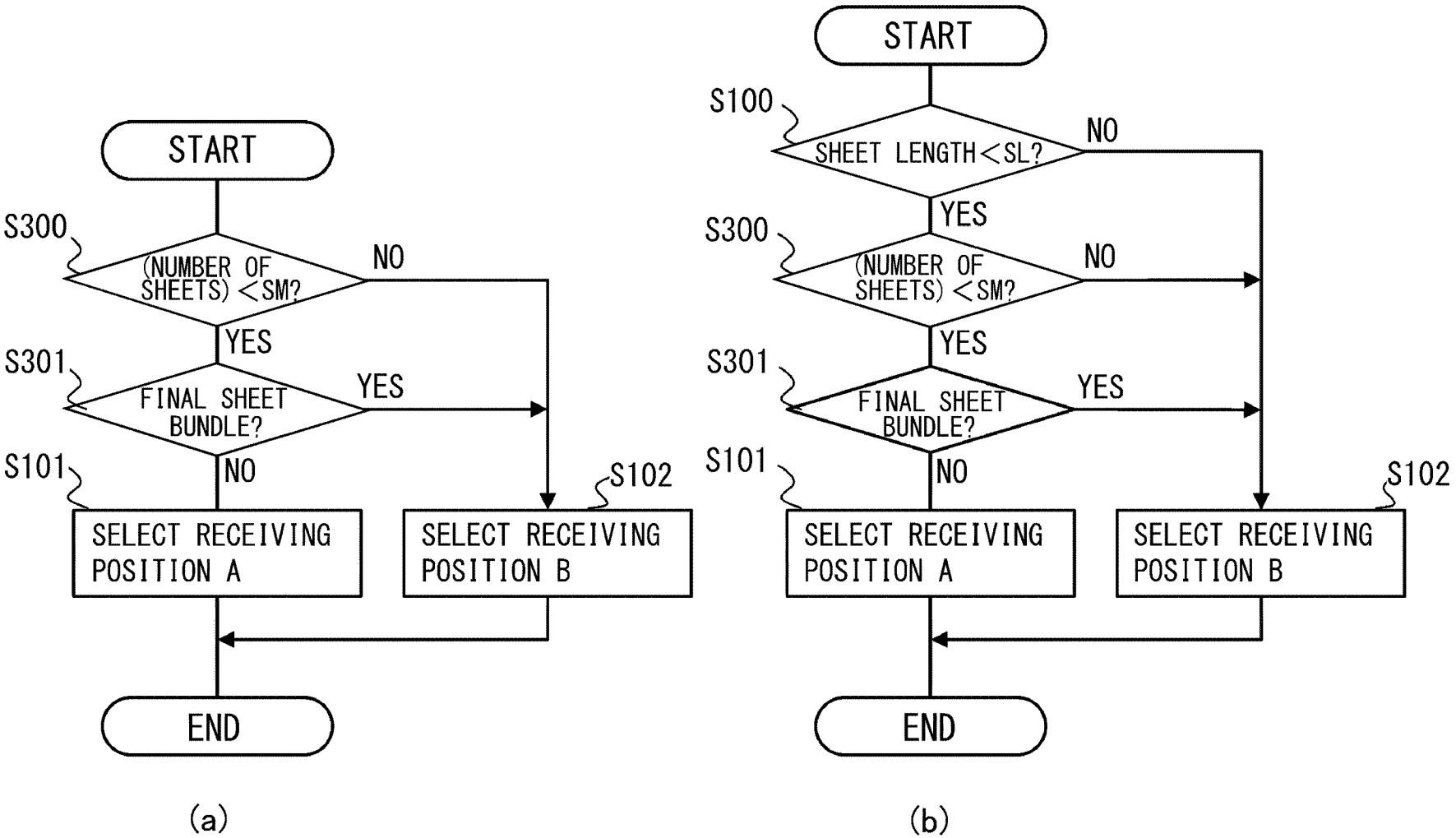

FIG. 12 is a flowchart showing processing of a sheet receiving position selecting portion in the embodiment 2 and another embodiment.

Figure 13:
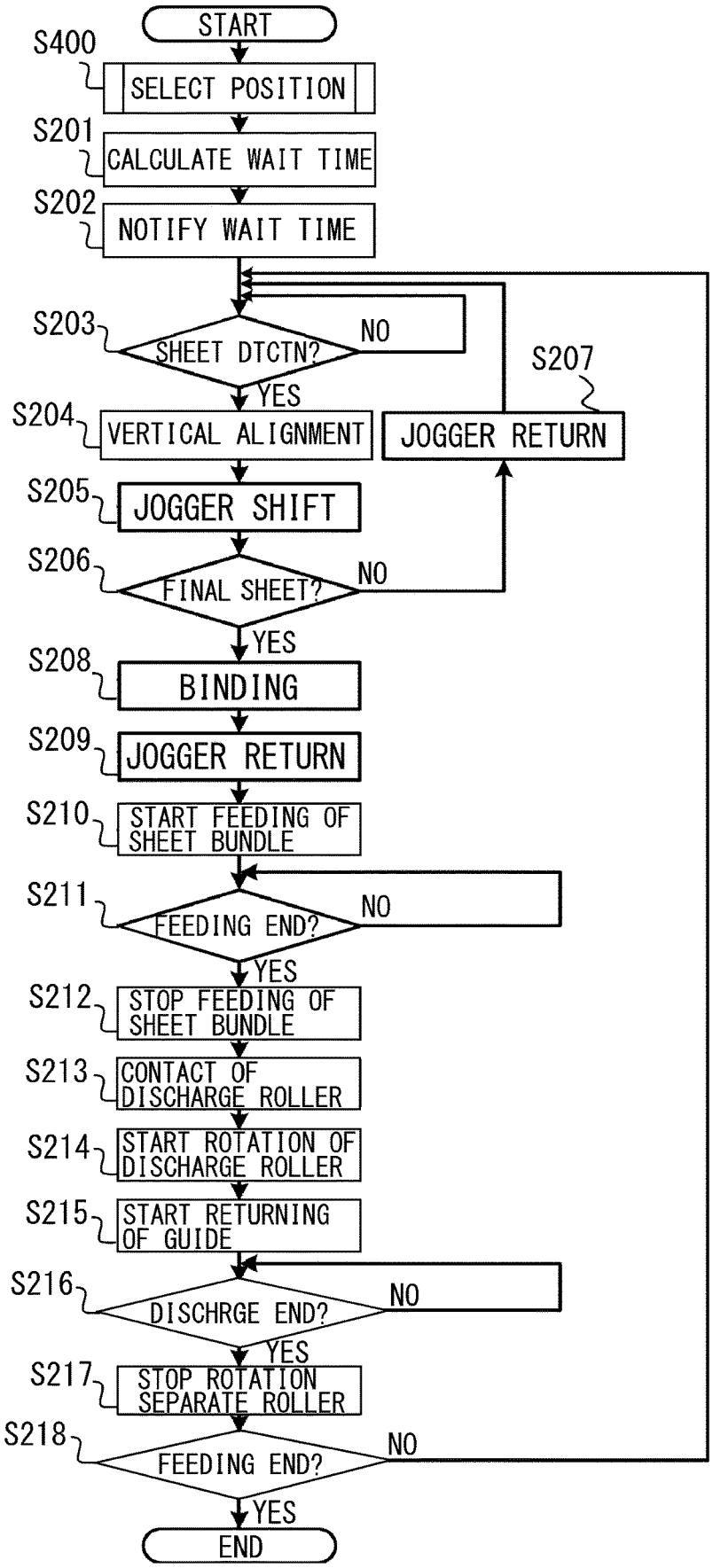

FIG. 13 is a flowchart showing operation processing of the binding processing portion in the embodiment 2.

DESCRIPTION OF THE EMBODIMENTS

In the following, embodiments for carrying out the present invention will be described with reference to the drawings.

Embodiment 1

Image Forming System

Figure 1:
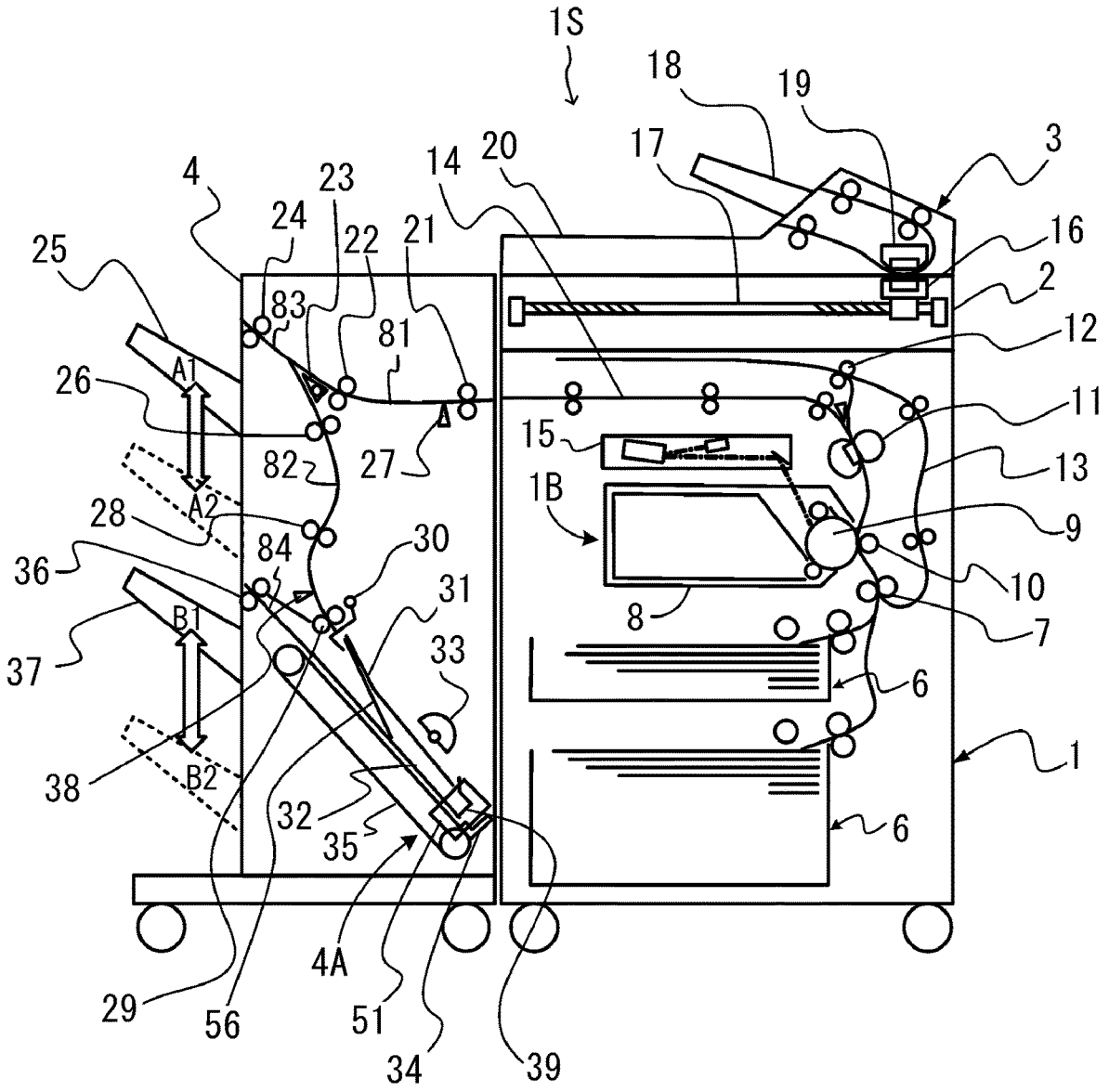
FIG. 1 is a schematic view of an image forming system according to embodiments 1 and 2.

FIG. 1 is a schematic view of an image forming system 1S of an embodiment 1. The image forming system 1S of the embodiment 1 is constituted by an image forming apparatus 1, an image reading device 2, an original feeding device 3, and a post-processing device 4. The image forming system 1S forms an image on a sheet which is a recording material, and as desired, the sheet is subjected to processing by the post-processing device 4 which is a sheet processing device and then is outputted. In the following, operations of respective devices are briefly described and then detailed description of the post-processing device 4 will be made.

The original feeding device 3 feeds an original placed on an original tray 18, to image reading portions 16 and 19. Each of the image reading portions 16 and 19 is an image sensor for reading image information from an original surface, and reading of double (both) sheets of the original is made by original feeding once. The original from which the image information is read is discharged to an original discharging portion 20. Further, the image reading device 2 is capable of reading image information from a static original set on an original platen glass by reciprocating the image reading portion 16 by a driving device 17. The static original includes an original such as a booklet original which cannot be used by the original feeding device 3.

The image forming apparatus 1 is an electrophotographic apparatus including an image forming portion 1B of a direct transfer type. The image forming portion 1B includes a cartridge 8 provided with a photosensitive drum 9 and includes a laser scanner unit 15 provided above the cartridge 8. In the case where an image forming operation is performed, the surface of a rotating photosensitive drum 9 is electrically charged, and the laser scanner unit 15 writes an electrostatic latent image on the surface of the photosensitive drum 9 (hereinafter, also referred to as a "drum surface") on the basis of the image information. The electrostatic latent image carried on the photosensitive drum 9 is developed into a toner image by charged toner particles, and the toner image is conveyed to a transfer portion where the photosensitive drum 9 and a transfer roller 10 oppose each other. A controller (printer controller 100) of the image forming apparatus 1 causes an image forming portion 1B to carry out an image forming operation on the basis of the image information read by the image reading portions 16 and 19 or the image information received from an external computer via a network.

The image forming apparatus 1 is provided with a plurality of feeding devices 6 each for feeding sheets one by one. The sheet fed from the feeding device 6 is subjected to correction of oblique movement thereof by a registration roller pair 7 and is sent to the transfer portion, where the toner image carried on the photosensitive drum 9 is transferred onto the sheet. On a sheet downstream of the transfer portion with respect to a sheet feeding direction, a fixing unit 11 is disposed. The fixing until unit 11 includes a rotatable member pair for nipping and conveying the sheet and a heat generating member such as a halogen lamp for heating the toner image, and fixing an image on the sheet by heating and pressing the toner image on the sheet.

In the case where the sheet on which the image is formed is discharged to an outside of the image forming apparatus 1, the sheet passed through the fixing unit 11 is conveyed to a post-processing device 4 via a horizontal feeding (conveying) portion 14. In the case of a sheet for which the image is formed on a first sheet in double sheet printing, the sheet passed through the fixing until unit 11 is delivered to a reversing roller 12 and is fed in a switch-back manner by the reversing roller 12 and then is fed again to the registration roller pair 7 via a re-feeding portion 13. Then, the sheet passes again through the transfer portion and the fixing unit 11, so that the image on a second sheet of the sheet and is thereafter fed to the post-processing device 4 via the horizontal feeding portion 14.

The image forming portion 1B is an example of an image forming means, and an electrophotographic unit of an intermediary transfer type in which the toner image formed on a photosensitive member (photosensitive drum) is transferred onto the sheet through an intermediary transfer member may be used. Further, a printing unit of an ink jet type or an offset type may be used as an image forming means.

Post-Processing Device

The post-processing device 4 receives the sheet from the image forming apparatus 1 and subjects the sheet to predetermined processing. The predetermined processing includes at least one of longitudinal (vertical) alignment processing, lateral (horizontal) alignment processing, binding processing, and discharge processing. The longitudinal alignment processing is processing for aligning end portions of a plurality of sheets with respect to the sheet feeding direction in a first feeding (conveying) mechanism described later. The lateral alignment processing is processing for aligning end portions of the plurality of sheets with respect to a direction perpendicular to the sheet feeding direction in the first feeding mechanism. The binding processing is processing for binding the plurality of sheets. The post-processing device 4 includes a binding processing portion 4A for subjecting the sheets to the binding processing, and subjects the sheets, received from the image forming apparatus 1, to the binding processing and then discharges the sheets as a sheet bundle. Further, the post-processing device 4 is also capable of simply discharging (discharge processing) the sheets without subjecting the sheets, received from the image forming apparatus 1, to the binding processing.

The post-processing device 4 includes a receiving path 81, an inner discharge path 82, a first discharge path 83, and a second discharge path 84 which are provided as feeding passages along which the sheets are fed, and is provided with an upper discharging tray 25 and a lower discharging tray 37 as discharging designations to which the sheets are discharged. The receiving path 81 is the feeding passage along which the sheets are received and fed from the image forming apparatus 1, and the inner discharge path 82 is the passage along which the sheets are fed toward the binding processing portion 4A. The first discharge path 83 is the feeding passage along which the sheets are discharged to the upper discharging tray 25, and the second discharge path 84 is the feeding passage along which the sheets are discharged to the lower discharging tray 37.

Along the receiving path 81, an entrance roller pair 21, a pre-buffer roller pair 22, and an entrance sensor 27 are provided. Along the first discharge path 83, a reversing roller pair 24 as a reversing means is provided. Along the inner discharge path 82, an inner discharging roller pair 26, an intermediary between roller pair 28, a kicking roller pair 29, and a pre-intermediary stacking sensor 38 are provided. Along the second discharge path 84, a bundle discharging roller pair 36 is provided. Each of the entrance sensor 27 and the pre-intermediary stacking sensor 38 detects passing of the sheet at a predetermined position in the associated feeding passage in the post-processing device 4 (hereinafter, this position is also referred to as a detecting position). As the entrance sensor 27 and the pre-intermediary stacking sensor 38, for example, an optical sensor for detecting presence or absence of the sheet in the detecting position with use of light can be used.

In the following, a sheet feeding passage in the post-processing device 4 will be described. The sheet discharged from the horizontal feeding portion 14 of the image forming apparatus 1 is received by the entrance roller pair 21 and passes through the receiving path 81, and is fed toward the pre-buffer roller pair 22. The entrance sensor 27 detects the sheet in the detecting position between the entrance roller pair 21 and the pre-buffer roller pair 22. The pre-buffer roller pair 22 feeds the sheet, received from the entrance roller pair 21, toward the first discharge path 83. In the case of the upper discharge tray 25 which is the destination of the sheet, the reversing roller pair 24 discharges the sheet, to the upper discharging tray 25, received from the pre-buffer roller pair 22.

In the case where the destination of the sheet is the lower discharging tray 37, the reversing roller pair 24 subjects the sheet, received from the pre-buffer roller pair 22, to the switch-back feeding and feeds the sheet to the inner discharge path 82. In a branch portion where the receiving path 81 and the inner discharge path 82 are branched from the first discriminate path 83 on a side upstream of the reversing roller pair 24 with respect to the feeding direction in the discharging direction of the sheet by the reversing roller pair 24, a back-flow preventing valve 23 is provided. The back-flow preventing valve 23 has a function of restricting that the sheet subjected to the switch-back processing by the reversing roller pair 24 is fed back to the receiving path 81.

The inner discharging roller pair 26, the intermediary feeding roller pair 28, and the kicking roller pair 29 which are disposed along the inner discharge path 82 feeds the sheets, received from the reversing roller pair 24, to the binding processing portion 4A while successively delivering the sheets. The pre-intermediary stacking sensor 38 detects the sheet between the intermediary feeding roller pair 28 and the kicking roller pair 29.

The binding processing portion 4A includes stapler 51 which is an example of a binding means and binds a sheet bundle at a predetermined position by the stapler 51 after the plurality of sheets received from the inner discharge path 82 are aligned with each other. Detailed constitution and operation of the binding processing portion 4A will be described later. The sheet bundle (set) bound by the binding processing portion 4A is delivered to a bundle discharging roller pair 36 via the second discharge path 84 by slide movement of a bundle discharging guide 34 which is a pushing-out member of the binding processing portion 4A. Then, the sheet bundle is discharged to the lower discharging tray 37 by the bundle discharging roller pair 36 which is a second feeding mechanism of the binding processing portion 4A.

Each of the upper discharging tray 25 and the lower discharging tray 37 is movable vertically relative to a casing of the post-processing device 4. The post-processing device 4 is provided with sheet surface sensors (not shown) for detecting upper surface positions (sheet stacking heights) of the sheets on the upper discharging tray 25 and the lower discharging tray 37, respectively, and when either one of the sensors detects the sheet, the post-processing device 4 lowers a corresponding tray in an associated one of an arrow A2 direction and an arrow B2 direction. By this, the upper discharging tray 25 or the lower discharging tray 37 is moved to an associated position indicated by a broken line in FIG. 1. Further, when removal of the sheet(s) on the upper discharging tray 25 or the upper discharging tray 37 is detected by the associated sheet surface sensor, the tray is raised in the associated one of an arrow Al direction and an arrow A2 direction. Accordingly, the upper discharging tray 25 and the lower discharging tray 37 are controlled so as to be raised and lowered depending on a sheet stacking amount so that an upper surface of the sheet(s) is kept at a certain level. In the embodiment 1, each of the upper discharging tray 25 as a first stacking portion and the lower discharging tray 37 as a second stacking portion is subjected to the raising and lowering control by drive of the motor, but for example, a constitution in which each tray is capable of being raised or lowered by an urging means such as a spring.

Binding Processing Portion

Next, the binding processing portion 4A will be described. Part (a) of FIG. 2 is a perspective view showing the binding processing portion 4A, and part (b) of FIG. 2 is a perspective view showing the binding processing portion 4A in a state in which a part of members (upper intermediary guide 31) is open. As shown in the schematic views of FIGS. 1 and 2, the binding processing portion 4A includes the stapler 51, the upper intermediary guide 31, a lower intermediary guide 32, a longitudinal alignment reference plate 39, a longitudinal alignment roller 33, the bundle discharging guide 34, and a guide driving portion 35 which is the first feeding mechanism. The binding processing portion 4A forms a bound sheet bundle by subjecting the sheets, which are discharged from the inner discharge path 82 and which are stacked on an intermediary stacking portion described later, to the binding processing by the stapler 51.

The upper intermediary guide 31 and the lower intermediary guide 32 constitute the intermediary stacking portion on which the sheets which are objects to be processed are stacked. In the following, the upper intermediary guide 31 and the lower intermediary guide 32 are also referred to as the intermediary stacking portion. The lower intermediary guide 32 is a stacking portion of the sheet(s) discharged from the kicking roller pair 29 which is a most downstream roller pair in the inner discharge path 82.

On a side downstream of the kicking roller pair 29, a bundle pressing flag 30 is rotatably provided. A lower surface of the bundle pressing flag 30 presses a trailing end of the sheet discharged early on the intermediary stacking portion (hereinafter, this sheet is referred to as a current sheet). By this, a leading end of a sheet discharged later by the kicking roller pair 29 (hereinafter, this sheet is referred to as a subsequent sheet) passes through over the trailing end of the current sheet. That is, the bundle pressing flag 30 functions as a means for preventing collision between the sheets by moving a trailing end portion of the sheet discharged from the kicking roller pair 29. The lower surface of the bundle pressing flag 30 is disposed in a range with respect to a sheet widthwise direction in which the bundle pressing flag 30 can press opposite end portions of the sheet with respect to the sheet widthwise direction. The sheet widthwise direction is a direction perpendicular to the sheet feeding direction.

The longitudinal alignment roller 33 is disposed above the lower intermediary guide 32. The longitudinal alignment roller 33 is formed of an elastic material such as a synthetic rubber or an elastomer resin and includes a roller portion 33*a* adjusted so that an outer peripheral surface thereof has a predetermined friction coefficient. The roller portion 33*a* is supported by a shaft portion 33*b* rotatably supported by the upper intermediary guide 31, and is driven so as to be intermittently rotated every one rotation by a drive transmitting device including a gear portion 33*c*. The roller portion 33*a* which is an outer peripheral potion of the longitudinal alignment roller 33 has a non-circular shape as viewed in an axial direction of the shaft portion 33*b*. In a waiting (stand-by) state before the sheet is discharged on the intermediary stacking portion, the longitudinal alignment roller 33 is kept at an angle of rotation such that the roller portion 33*a* is not exposed form the upper intermediary guide 31. Further, during one full rotation of the longitudinal alignment roller 33, the roller portion 33*a* is temporarily exposed through an opening 31*a* provided in the upper intermediary guide 31, and contacts the upper surface of an uppermost sheet of the sheets stacked on the lower intermediary guide 32 and thus imparts a feeding force to the uppermost sheet. A contact pressure of the longitudinal alignment roller 33 to the sheet(s) is adjusted so that the longitudinal alignment roller 33 slips with the sheet after the sheet abuts against the longitudinal alignment reference plate 39.

The intermediary stacking portion is provided with a pressing guide 56 which is a flexible sheet member. The pressing guide 56 is disposed so as to contact the lower intermediary guide 32 and presses the upper surface of the sheets stacked on the intermediary stacking portion with a predetermined pressure. The longitudinal alignment reference plate 39 is provided downstream of the longitudinal alignment roller 33 with respect to a sheet discharging direction by the kicking roller pair 29. The longitudinal alignment reference plate 39 includes a reference wall 39*a* that projects, as a restricting portion contactable to end portions of the sheets, upward from the upper surface of the lower intermediary guide 32. Further, the longitudinal alignment reference plate 39 is provided in, for example, two positions on opposite sheets of a direction (sheet widthwise direction) perpendicular to the sheet discharging direction.

In the following, in the binding processing portion 4A, a direction of movement of the sheet, toward the longitudinal alignment reference plate 39, discharged by the kicking roller pair 29 is referred to as a "longitudinal alignment direction X1". The longitudinal alignment direction X1 is not only a direction along a normal feeding direction in the inner discharge path 82 but also a direction in which the longitudinal alignment roller 33 is moved toward the longitudinal alignment reference plate 39. Further, a direction opposite to the longitudinal alignment direction X1, i.e., a direction in which the sheet bundle is discharged from the binding processing portion 4A is referred to as a "bundle discharge direction X2".

The stapler 51 is mounted on the intermediary stacking portion and subjects the sheets, aligned with respect to the longitudinal alignment direction X1 and the sheet widthwise direction, to the binding processing in a predetermined position. The stapler 51 is provided on the same sheet as a lateral alignment reference plate 52 with respect to the sheet widthwise direction and is disposed movable in the longitudinal alignment direction X1 and the bundle discharge direction X2. Further, the lower intermediary guide 32 has a space (area) in which A4-size sheets fed in a long-sheet feeding direction can be stacked. Here, the long-sheet feeding direction refers to a feeding direction such that the longitudinal alignment direction X1 is a long-sheet direction and that the sheet widthwise direction is a short-sheet direction.

Accordingly, the stapler 51 is capable of performing not only corner binding such that the sheet bundle stacked on the intermediary stacking portion is bound in a corner but also a long-sheet binding operation in which the stapler 51 binds the sheet bundle in a plurality of positions along the long side of the sheet bundle while moving relative to the sheet bundle. Arrows F and G and a lateral alignment jogger 58 will be described later.

Image Forming System

FIG. 3 is a block diagram showing a hardware constitution of the image forming system 1S of the embodiment 1. In the image forming apparatus 100, the printer controller 100 is mounted, and in the post-processing device 4, a finisher controller 400 is mounted. The printer controller 100 and the finisher controller 400 are connected to each other via a communication interface and control an operation of the image forming system 1S in cooperation with each other.

The printer controller 100 includes a central processing unit (CPU) 101 and a memory 102. The CPU 101 reads and executes a program stored in the memory 102 and integrally controls the image forming apparatus 1. For example, the CPU 101 executes processing by causing the image forming portion 1B to execute the image forming operation and executes processing for acquiring the image information by causing the image reading device 2 to execute a reading operation. The memory 102 includes a non-volatile storing medium such as a read-only memory (ROM) and a volatile storing medium such as a random-access memory (RAM), and becomes not only a storage space of programs and data but also a working (operation) space when the CPU 101 executes the programs. The memory 102 is an example of a non-transient storing medium in which the program for controlling the image forming apparatus 1 is stored.

The printer controller 100 is connected to an external device 105 such as a personal computer or a portable information device via an external interface (I/F) 104 and receives an execution instruction or the like of an image forming job to the image forming system 1S. Further, the printer controller 100 is connected to an operating display portion 103 which is a user interface of the image forming system 1S. The operating display portion 103 includes a display device such as a liquid crystal panel for presenting information to a user and an input device, such as a touch panel function portion of physical button and a liquid crystal panel, for receiving an input operation by the user. The printer controller 100 carries out communication with the operating display portion 103, whereby the printer controller 100 controls display contents of the display device and receives information inputted through the input device.

The finisher controller 400 includes a central processing unit (CPU) 401, a memory 402, and an I/O port 403. The CPU 401 reads and executes a program stored in the memory 402 and integrally controls the post-processing device 4. The memory 402 includes a non-volatile storing medium such as a read-only memory (ROM) and a volatile storing medium such as a random-access memory (RAM), and becomes not only a storage space of programs and data but also a working (operation) space when the CPU 401 executes the programs. The memory 402 is an example of a non-transient storing medium in which the program for controlling the image post-processing device 4 is stored.

The CPU 401 and the memory 402 are connected to the I/O port 403 via a bus 404, and the I/O port 404 permits output and input of control signals to various constituent elements of the post-processing device 4.

Incidentally, various functions of the printer controller 100 and the finisher controller 400 may be implemented as independent hardware on a circuit of the controller or may be implemented as a function unit of the program in a software form. Further, a part or all of functions of the finisher controller 400 described below can also be performed by the printer controller 100.

To the I/O port 403, the entrance sensor 27, the pre-intermediary stacking sensor 38, and the stapler 51, and in addition, a plurality of motors (M1 to M12) which are driving sources for feeding the sheets and driving sources for the binding processing portion 4A. An entrance motor M1 rotationally drives an entrance roller 21. A pre-buffer motor M2 rotationally drives a pre-buffer roller pair 22. A reverse motor M3 rotationally drives a reverse roller 24. An inner discharge motor M3 rotationally drives an inner discharge roller 26. A kicking(-out) motor M5 rotationally drives a kicking(-out) roller pair 29.

A longitudinal alignment motor M6 supplies a driving force for intermittently operating a longitudinal alignment roller 33 by one rotation. A jogger driving motor M7 moves a lateral alignment jogger 58 in the sheet widthwise direction. A stapler driving motor M8 moves the stapler 51 in the longitudinal alignment direction X1 and the bundle discharge direction X2. A binding motor M9 causes the stapler 51 to perform a binding operation of the sheet bundle. A guide driving motor M10 drives a guide driving portion 35, and slides and moves a bundle discharging guide 34.

The guide driving motor M10 moves the bundle positioning guide 34 in the longitudinal alignment direction X1 by rotational drive in the clockwise direction (hereinafter, referred to as a CW direction), and moves the bundle discharging guide 34 in the bundle discharging direction X2 by rotational drive in the counterclockwise direction (hereinafter, referred to as a CCW direction). A bundle discharge roller driving motor M11 rotationally drives a bundle discharge roller 36. A bundle discharge contact/separation motor M12 causes a roller pair of the bundle discharge roller 36 to contact each other by the rotational drive in the CW direction, and causes the roller pair of the bundle discharge roller 36 to separate from each other by the rotational drive in the CCW direction.

Function Constitution

FIG. 4 is a block diagram showing a function constitution of the image forming system 1S. Incidentally, in FIG. 4, principally, only the binding processing portion 4A of the post-processing device 4 and a portion relating to sheet feeding control after the binding processing in the embodiment 1 are extracted and shown, and other portions are omitted from illustration. The finisher controller 400 is constituted by a sheet feeding controller 410, a sheet receiving position selecting portion 411, a contact/separation controller 412, and a post-processing controller 413. Each of the controllers (410 to 413) is controlled by execution of the program read from the memory 402 by the CPU 401 of the finisher controller 400 (FIG. 3).

The sheet feeding controller 410 drives the guide driving motor M10 to slide and move the bundle discharging guide 34 in the bundle discharging direction X2 through the guide driving portion 35, so that the sheets stacked on the lower intermediary guide 32 are fed. Further, the sheet feeding controller 410 drives the bundle discharge roller driving motor M11 to rotate the bundle discharging roller 36, so that the sheets fed by the bundle discharging guide 34 onto the lower discharging tray 37. Further, the sheet feeding controller 410 causes the guide driving motor M10 to slide and move the bundle discharging guide 34 to a waiting position in the longitudinal alignment direction X1, so that the bundle discharging guide 34 is put in a state in which the bundle discharging guide 34 is capable of receiving a subsequent sheet. In the embodiment 1, each of a moving speed of the bundle discharging guide 34 and a sheet feeding speed of the bundle discharging roller 36 is 200 mm/sec, for example.

The contact/separation controller 412 drives the bundle discharge roller contact/separation motor M12, so that a roller pair (upper roller 36*a*, lower roller 36*b* (see FIG. 6) of the bundle discharging roller 36 is contacted to or separated from each other. In this embodiment, each of a time in which the bundle discharging roller 36 is moved from a contact state to a separated state and a time in which the bundle discharging roller 36 is moved from the separated state to the contact state is 300 milliseconds, for example. The sheet feeding controller 410 feeds the sheets, fed by the bundle discharging guide 34, to a position of the bundle discharging roller 36 in a state in which the bundle discharging roller 36 is separated by the contact/separation controller 412. Then, the rollers 36*a* and 36*b* of the bundle discharging roller 36 are contacted to each other by the contact/separation controller 412, and then the sheet is received by the bundle discharging roller pair 36 by being nipped by the bundle discharging roller pair 36.

Receiving Position Selection

The sheet receiving position selecting portion 411 selects a sheet receiving position of the bundle discharging roller pair 36 on the basis of information of the sheet (hereinafter, referred to as "sheet information"). Here, the sheet information includes, for example, information indicating sheet characteristics, such as a size (A4, B4, sheet length, or the like), a basis weight (g/m$^2$), glossiness, and the like. Selecting processing of the receiving position based on the sheet information of the sheet receiving position selecting portion 411 will be described using a flowchart shown in FIG. 5. When the receiving position selecting processing based on the sheet information is started, in a step (hereinafter, referred to as "S") 100, the sheet receiving position selecting portion 411 discriminates whether or not a length, with respect to the sheet feeding direction, of the sheet subjected to processing by the binding processing portion 4A (hereinafter, this length is referred to as a sheet length) is less than a length SL (predetermined length). In the embodiment 1, the length SL which is the predetermined length is, for example, 356.6 mm which is a longitudinal feeding length of a sheet with a legal size.

In the where the sheet receiving position selecting portion 411 discriminated in S100 that the sheet length is less than the length SL (predetermined length), the processing goes to S101, and in the case where the sheet receiving position selecting portion 411 discriminated in S100 that the sheet length is not less than the length SL (predetermined length), the processing goes to S102. In S101, the sheet receiving position selecting portion 411 selects a receiving position A and ends the processing. For example, the sheet receiving position selecting portion 411 selects the receiving position A in the case where the sheet length is a longitudinal feeding length (279.4 mm) of a sheet with a letter size. In S102, the sheet receiving position selecting portion 411 selects a receiving position B and ends the processing. For example, the sheet receiving position selecting portion 411 selects the receiving position B in the case where the sheet length is the longitudinal feeding length of the sheet with the legal size.

In the embodiment 1, the receiving position A which is a first position is a position where a leading end of the sheet advances from a nip position of the bundle discharging roller pair 36 in the bundle discharging direction X2 by 10 mm, for example. It can be said that the receiving position A is position where the sheet fed by the guide driving portion 35 is stopped on the basis of the sheet information. The receiving position B which is a second position is a position where the leading end of the sheet advances from the nip position of the bundle discharging roller pair 36 in the bundle discharging direction X2 by 140 mm, for example. It can be said that the receiving position B is a position where the sheet fed by the guide driving portion 35 is stopped and which is downstream of the receiving position A with respect to the sheet feeding direction. The receiving position B is a position where the second feeding mechanism receives the sheet on a side downstream of the receiving position A with respect to the sheet feeding direction. The sheet receiving position selecting portion 411 functions as a selecting means for selecting, on the basis of the sheet information, whether the sheet is received in the receiving position A or the receiving position B. In other words, it can be said that the sheet receiving position selecting portion 411 is a selecting means for selecting whether the sheet is fed by the guide driving portion 35 to which one of the receiving position A and the receiving position B. The receiving position B is set, as a position where the leading end of the sheet further advances from the receiving position A in the bundle discharging direction X2, so as to reduce a sheet feeding distance by the bundle discharging roller pair 36.

Running to FIG. 4, the post-processing controller 413 controls the longitudinal alignment motor M6, the jogger driving motor M7, the stapler moving motor M8, and the binding motor M9, so that the longitudinal alignment processing, the lateral alignment processing, and the binding processing which are described above are performed. The longitudinal alignment roller 33 is used in the longitudinal alignment processing, the lateral alignment jogger 58 is used in the lateral alignment processing, and the stapler 51 is used in the binding processing.

Binding Processing Operation and Sheet Discharging Operation

In the following, an operation in which the sheets are aligned in the binding processing portion 4A and are bound into a sheet bundle by the stapler 51 and then in which the sheet bundle is discharged onto the lower discharging tray 37 will be described. Side views of FIG. 6 to FIG. 9 (parts (a) and (c) of each of FIGS. 6 to 8 and parts (a) to (c) of FIG. 9) are schematic views as viewed in an arrow F direction (sheet widthwise direction) in part (a) of FIG. 2. Plan views of FIG. 6 to FIG. 8 (parts (b) and (d) of each of FIGS. 6 to 8) are schematic views as viewed in an arrow G direction in part (a) of FIG. 2.

Parts (a) and (b) of FIG. 6 shows a state in which a sheet S1 which is a first sheet is being fed to the binding processing portion 4A. The kicking roller pair 29 discharges the sheet S1 to the intermediary stacking portion while nipping the sheet S1. Further, the bundle pressing flag 30 is rotated in a J1 direction of a double-pointed arrow by being pressed by the sheet S1, and thus retracted from a discharge passage of the sheet S1. The sheet S1 passes through between the lateral alignment jogger 58 and the lateral alignment reference plate 52 disposed in waiting positions with respect to the widthwise direction, and is moved in the longitudinal alignment direction X1. The bundle discharging guide 34 waits in a waiting position disposed downstream of the longitudinal alignment reference plate 39 with respect to the longitudinal alignment direction X1. Incidentally, a base member 59 is a member for connecting the bundle discharging guide 34 with the guide driving portion 35.

Parts (c) and (d) of FIG. 6 shows a state immediately after a trailing end (trailing end with respect to the longitudinal alignment direction X1, end portion on the bundle discharging direction X2 side) of the sheet S1 (first sheet) passed through the kicking roller pair 29. The sheet S1 is released from the nipping by the kicking roller pair 29, so that the bundle pressing flag 30 is rotated in a J2 direction and thus a trailing end portion of the sheet S1 is lowered below the nip position of the kicking roller pair 29. At this time, the sheet S1 is nipped between the pressing guide 56 and the lower intermediary guide 32. Further, at a point of time when the trailing end of the sheet S1 passed through the kicking roller pair 29, the leading end of the sheet S1 with respect to the longitudinal alignment direction X1 advances to a lower position of the longitudinal alignment roller 33.

As shown in parts (a) and (b) of FIG. 7, after the trailing end of the sheet S1 passes through the kicking roller pair 29, the roller portion 33*a* of the longitudinal alignment roller 33 rotating in an arcuate arrow N direction in these figures contacts the sheet S1 and moves the sheet S1 in the longitudinal alignment direction X1. By this, the leading end of the sheet S1 is abutted against the longitudinal alignment reference plate 39, so that a state (longitudinal alignment state) in which the position of the sheet S1 is aligned with respect to the longitudinal alignment direction X1 is formed.

As shown in parts (c) and (d) of FIG. 7, after the sheet S1 is spaced from the longitudinal alignment roller 33, the lateral alignment jogger 58 moves in an arrow M1 direction, so that the sheet S is moved toward the lateral alignment reference plate 52. By this, an end portion (side end) of the sheet S1 with respect to the sheet widthwise direction is abutted against the lateral alignment reference plate 52, so that a state (lateral alignment state) in which the position of the sheet S1 is aligned with respect to the sheet widthwise direction (lateral direction) is formed.

As shown in parts (a) and (b) of FIG. 8, when the alignment of the sheet S1 with respect to the lateral direction is ended, the lateral alignment jogger 58 moves in an arrow M2 direction and returns to the waiting position. By this, the binding processing portion 4A is in a state in which the binding processing portion 4A is capable of receiving a subsequent sheet S2. Thereafter, the operations from parts (a) and (b) of FIG. 7 to parts (a) and (b) of FIG. 8 are repeated until alignment of a final sheet constituting a single sheet bundle (set). Then, when alignment operations of the final sheet in the longitudinal direction and the lateral direction are completed, the stapler 51 binds the sheet bundle in a predetermined position.

As shown in parts (c) and (d) of FIG. 8, when a binding operation is performed by the stapler 51, drive of the guide driving portion 35 is started, so that the bundle discharging guide 34 connected to the guide driving portion 35 via the base member 59 is moved from the waiting position indicated by a broken line in an H1 direction. By this, a sheet bundle SB in a bound state is pushed out toward the bundle discharging roller pair 36 in the bundle discharging direction X2. At this time, the upper roller 36*a* and the lower roller 36*b* of the bundle discharging roller pair 36 are spaced from each other. A distance L0 is a distance from the waiting position of the bundle discharging guide 34 to the nip position of the bundle discharging roller pair 36.

Further, the sheet bundle SB is guided to the bundle discharging roller pair 36 by an upper discharging guide 85 forming the second discharging path 84 and an upstream portion (portion extending toward a side downstream of the kicking roller pair 29 in the bundle discharging direction X2). At this time, in the case where the sheet bundle SB has, for example, the letter size and the receiving position A is selected by the above-described sheet receiving position selecting portion 411, the following state shown in part (a) of FIG. 9 is formed. That is, the bundle discharging guide 34 is temporarily stopped in a position where the leading end of the sheet bundle SB with respect to the bundle discharging direction X2 advances from the nip position of the bundle discharging roller pair 36 by 10 mm (arrow RA). Further, in the case where the sheet bundle SB has, for example, the legal size and the receiving position B is selected by the sheet receiving position selecting portion 411, the following state shown in part (b) of FIG. 9 is formed. That is, the bundle discharging guide 34 is temporarily stopped in a position where the leading end of the sheet bundle SB with respect to the bundle discharging direction X2 advances from the nip position of the bundle discharging roller pair 36 by 140 mm (arrow RB).

Each of LA of part (a) of FIG. 9 and LB of part (b) of FIG. 9 refers to a movement distance of the bundle discharging guide 34, and hereinafter, these distances are referred to as a movement distance LA and a movement distance LB, respectively. Each of the movement distance LA and the movement distance LB is acquired by subtracting a length of the sheet bundle SB from the sum of the distance L0 and the distance (RA or RB) in which the leading end of the sheet bundle SB advances from the nip position of the bundle discharging roller pair 36.

(Movement distance of bundle discharging guide 34)=(Distance L0)-((Length of sheet bundle SB)−(Distance in which leading end of sheet bundle SB advances from the nip position of the bundle discharging roller pair 36)) formula (1)

Here, the movement distance of the bundle discharging guide 34 is also a feeding distance of the sheet bundle SB by the bundle discharging guide 34.

The distance L0 from the waiting position of the bundle discharging guide 34 to the nip position of the bundle discharging roller pair 36 is 440 mm, for example. Therefore, from the formula (1), the movement distance LA of the bundle discharging guide 34 in the case where the sheet bundle SB with the letter size length is received at the receiving position A is 170.6 mm (=440 mm−(279.4 mm−10 mm)). Further, the movement distance LB of the bundle discharging guide 34 in the case where the sheet bundle SB with the legal-size length is received at the receiving position B is 224.4 mm (=440 mm−(355.6 mm−140 mm)).

Next, the upper roller 36*a* moves in a P1 direction, so that the bundle discharging roller pair 36 is in a contact state. When the contact of the bundle discharging roller pair 36 is completed, the bundle discharging roller driving motor M11 is driven, so that rotation of the bundle discharging roller pair 36 is started. The sheet bundle SB is nipped by the bundle discharging roller pair 36 and is subsequently discharged in the bundle discharging direction X2 by the bundle discharging roller pair 36. In addition, the bundle discharging guide 34 starts movement in the longitudinal alignment direction X1 (H2 direction) for receiving a subsequent sheet.

As shown in part (c) of FIG. 9, when the trailing end of the sheet bundle SB with respect to the bundle discharging direction X2 passes through the bundle discharging roller pair 36, the upper roller 36*a* moves in a P2 direction, so that the bundle discharging roller pair 36 is in a separated state again. The sheet bundle SB discharged to an outside of the post-processing device 4 by the bundle discharging roller pair 36 is stacked on the lower discharging tray 37. Further, the movement of the bundle discharging guide 34 to the waiting position is completed, so that the binding processing portion 4A is in a state in which the binding processing portion 4A is capable of receiving the subsequent sheet.

The feeding distance of the sheet bundle SB by the bundle discharging roller pair 36 is acquired by subtracting the distance (distance RA or RB) in which the leading end of the sheet bundle SB advances from the nip position of the bundle discharging roller pair 36, from the length of the sheet bundle SB.

(Feeding distance of sheet bundle SB by bundle discharging roller pair 36)=(Length of sheet bundle SB)−(Distance in which leading end of sheet bundle SB advances from nip position of bundle discharging roller pair 36) formula (2)

From the formula (2), the feeding distance LA of the sheet bundle SB by the bundle discharging roller pair 36 in the case where the sheet bundle SB with the letter size length is received at the receiving position A is 269.4 mm (=279.4 mm−10 mm). Further, the feeding distance LB of the sheet bundle SB by the bundle discharging roller pair 36 in the case where the sheet bundle SB with the legal-size length is received at the receiving position B is 215.6 mm (=355.6 mm−140 mm).

A returning time from a start of the discharge of the sheet bundle SB by the bundle discharging guide 34 to movement to the waiting position for receiving the subsequent sheet, in other words, a reciprocating time of the bundle discharging guide 34 is acquired in the following manner. That is, the returning time (reciprocating time) is acquired from the sum of a time obtained by dividing a distance which doubles the movement distance of the bundle discharging guide 34 by a moving speed of the bundle discharging guide 34 and a time required for a contact operation of the bundle discharging roller pair 36.

(Returning time from start of discharge of sheet bundle SB by bundle discharging guide 34 to movement to waiting position for receiving subsequent sheet)={(movement distance of bundle discharging guide 34)×2/(moving speed of bundle discharging guide 34}+(contact time of bundle discharging roller pair 36) formula (3)

From the formula (3), the reciprocating time of the bundle discharging guide 34 in the case where the sheet bundle SB with the letter size length is received at the receiving position A is 2006 milliseconds (ms) (=170.6 mm×2/0.2 mm/ms+300 ms). Further, the reciprocating time of the bundle discharging guide 34 in the case where the sheet bundle SB with the legal-size length is received at the receiving position B is 2544 ms (=224.4 mm×2/0.2 mm/ms+300 ms).

For comparison, calculation results using the formulas (1), (2) and (3) in the case where the sheet bundle SB with the letter size length is received at the receiving position B and the case where the sheet bundle SB with the legal-size length is received at the receiving position A are shown in a table 1 in combination with the above-described cases.

TABLE 1

| SL*1 | RP*4 | SFDBG*5 | SFDBR*6 | RT*7 |
|---|---|---|---|---|
| LTS*2 | A(10 mm) | 170.6 mm | 269.4 mm | 2006 ms |
| (279.4 mm) | B(140.0 mm) | 300.6 mm | 139.4 mm | 3306 ms |
| LGS*3 | A(10 mm) | 94.4 mm | 345.6 mm | 1244 ms |
| (355.6 mm) | B(140 mm) | 224.4 mm | 215.6 mm | 2544 ms |

*1"SL" is the sheet length.
*2"LTS" is the letter size.
*3"LGS" is the legal size.
*4"RP" is the receiving position (the advance distance of the sheet leading end from the bundle discharging roller nip).
*5"SFDBG" is the sheet feeding distance by the bundle discharging guide.
*6"SFDBR" is the sheet feeding distance by the bundle discharging roller.
*7"RT" is the reciprocating time of the bundle discharging guide.

In the table 1, the sheet length, the receiving position, the sheet bundle SB feeding (movement) distance by the bundle discharging guide 34 according to the formula (1), the sheet bundle SB feeding distance by the bundle discharging roller pair 36 according to the formula (2), and the reciprocating time of the bundle discharging guide 34 according to the formula (3) are shown in first to fifth columns, respectively.

As in the case of the bundle discharging roller pair 36, there is a possibility that the sheet is obliquely moved due to a slip or the like of the sheet in the sheet feeding by the rollers. When the sheets are stacked on the lower discharging tray 37 in an obliquely moved state of the sheets, the sheet feeding has the influence of an alignment state of the sheets on the lower discharging tray 37. In the case where the sheet length of the sheet bundle SB is long, the feeding distance by the bundle discharging roller pair 36 is also long, so that compared with the case where the sheet length is short, a possibility that the sheet is obliquely moved becomes high. Therefore, the sheet receiving position selecting portion 411 selects the receiving position B of the bundle discharging roller pair 36 in the case where the sheet length of the sheet bundle SB is long, so that the sheet feeding distance by the bundle discharging roller pair 36 is decreased. By this, for example, as regards the sheet with the legal-size length, the sheet receiving position selecting portion 411 does not select the receiving position A when the sheet feeding distance by the bundle discharging roller pair 36 is 345.6 mm but selects the receiving position B where the sheet feeding distance is 215.6 mm. Incidentally, as regards the sheet with the letter size length, the receiving position A where the reciprocating time of the bundle discharging guide 34 becomes shorter than the reciprocating time in the case of the receiving position B is selected.

Control Sequence of Binding Processing Operation and Sheet Discharging Operation A control sequence of the binding processing and the sheet discharge which realize the above-described operations will be described along a flowchart of FIG. 10. Respective processes of the flowchart are performed by executing the program read from the memory 402 by the CPU 401 of the finisher controller 400 (FIG. 3).

Further, this operation sequence is started in the case where the finisher controller 400 receives notification, from the printer controller 100, indicating a start of execution of an image forming job requiring the binding processing by the binding processing portion 4A.

In S200, on the basis of sheet information (for example, the sheet length) of the image forming job received from the printer controller 100, the CPU 401 causes the sheet receiving position selecting portion 411 to select the receiving position of the bundle discharging roller pair 36. A selecting method is as described above using the flowchart of FIG. 5. In S201, the CPU 401 calculates a wait(ing) time necessary for the sheet interval in which the sheets are fed to the binding processing portion 4A (necessary wait time). In the binding processing portion 4A, a longitudinal alignment operation by the longitudinal alignment roller 33, a lateral alignment operation by the lateral alignment jogger 58, a binding operation by the stapler 51, and a sheet bundle feeding operation by the bundle discharging guide 34 are performed.

Calculation of Necessary Wait Time

In an interval bundle, a sheet and a subsequent sheet of the sheet bundle (herein, this interval is also referred to as the sheet interval) requires the sum (total time) of a longitudinal alignment operation time by the longitudinal alignment roller 33 and a lateral alignment operation time by the lateral alignment jogger 58.

(Necessary wait time in sheet interval of sheet bundle)=(longitudinal alignment operation time)+(lateral alignment operation time) formula (4)

In the embodiment 1, as an example, a constitution in which the longitudinal alignment operation time of 200 ms and the lateral alignment operation time of 300 ms are required. From the formula (4), the necessary wait time for the sheet interval of the sheet bundle is 500 ms (=200 ms+300 ms).

Between a final sheet of a sheet bundle and a first sheet of a subsequent sheet bundle, a total time of the following times is required. That is the total time of the longitudinal alignment time, the lateral alignment operation time, a binding operation time by the stapler 51, a sheet bundle feeding time by the bundle discharging guide 34, and a returning time of (movement of) the bundle discharging guide 34 to the waiting position is required. The sheet bundle feeding time by the bundle discharging guide 34 and the returning time of the bundle discharging guide 34 to the waiting position are calculated using the bundle discharging guide reciprocating time in the above-described table 1.

(Necessary wait time between final sheet of sheet bundle and first sheet of subsequent sheet bundle)=(longitudinal alignment operation time)+(lateral alignment operation time)+(binding operation time)+(bundle discharging guide reciprocating time) formula (5)

In the embodiment 1, as an example, a constitution in which the binding operation time of 1000 ms is required is employed. This time is a time in which long-side binding of the sheet bundle described later is not performed and is a time to which a moving time of the stapler moving motor M8 is added in the case where the long-side binding of the sheet bundle is performed. For example, the binding operation time is 3000 ms.

From the formula (5), the necessary wait time between the final sheet of the sheet bundle and the first sheet of the subsequent sheet bundle in the case where the long-side binding is not performed becomes 3506 ms (=500 ms+1000 ms+2006 ms) in the case of the letter size and the receiving position A. On the other hand, in the case of the legal size and the receiving position B, the necessary wait time becomes 4044 ms (=500 ms+1000 ms+2544 ms). As regards the necessary wait time, wait times between all the adjacent sheets contained in the sheet information of the image forming job are calculated.

Returning to description of FIG. 10, in S202, the CPU 401 notifies the printer controller 100 of the calculated necessary wait time between the sheets. In S203, the CPU 401 discriminates whether or not the pre-intermediary stacking sensor 38 detected that the sheet reached, i.e., detected the sheet. The CPU 401 waits the sheet fed to the binding processing portion 4A. In the case where the CPU 401 discriminated in S203 that the pre-intermediary stacking sensor 38 does not detect the sheet, the process is returned to S203, and in the case where the CPU 401 discriminated in S203 that the pre-intermediary stacking sensor 38 detected the sheet, the process is caused to go to S204. In S204, in synchronism with the feeding of the sheet, the CPU 401 drives the longitudinal alignment motor M6, so that the longitudinal alignment motor 33 is rotated one full turn and thus the longitudinal alignment operation is performed. In S205, the CPU 401 drives the jogger driving motor M7, so that the lateral alignment operation (jogger shifting operation) in which the lateral alignment jogger 58 is moved from the waiting position toward the lateral alignment reference plate 52.

In S206, the CPU 401 discriminates whether or not the current sheet is a final sheet (whether or not the current sheet is a sheet, of the sheets constituting the sheet bundle, finally received by the binding processing portion 4A). In the case where the CPU 401 discriminated in S206 that the current sheet is not the final sheet of the sheet bundle, the process is caused to go to S207. In S207, the CPU 401 causes the lateral alignment jogger 58 to move toward the waiting position and then returns the process to S203, and then repeats the processes of S203 to S207.

In the case where the CPU 401 discriminated in S206 that the current sheet is the final sheet of the sheet bundle, the CPU 401 causes the process to go to S208.

In S208, the CPU 401 causes the stapler 51 to perform the binding operation of the sheet bundle. In the case where the long-side binding of the sheet bundle is performed, the sheet bundle is bound at a plurality of positions along the long side by the stapler 51 while moving the stapler 51 in the longitudinal alignment direction X1 or the bundle discharging direction X2 by the stapler moving motor M8. In S209, the CPU 401 returns the lateral alignment jogger 58 to the waiting position. In S210, the CPU 401 causes the bundle discharging guide 34 in the bundle discharging direction X2, so that the feeding of the sheet bundle is started.

In S211, the CPU 401 discriminates whether or not the leading end of the sheet bundle SB with respect to the bundle discharging direction X2 passes through the bundle discharging roller pair 36 put in the separated state and feeding of the sheet bundle SB to a receiving position selected by the sheet receiving position selecting portion 411 is completed. In the case where the CPU 401 discriminated in S211 that the sheet bundle SB is not fed to the receiving position, the CPU 401 returns the process to S211, and in the case where the CPU 401 discriminated in S211 that the sheet bundle SB is fed to the receiving position, the CPU 401 causes the process to go to S212. In S212, the CPU 401 stops the feeding of the sheet bundle SB by the bundle discharging guide 34. In S213, the CPU 401 lowers the upper roller 36*a* of the bundle discharging roller pair 36 and causes the bundle discharging roller pair 36 to nip the sheet bundle (bundle discharging roller contact). In S214, the CPU 401 starts rotation of the bundle discharging roller pair 36. In S216, the CPU 401 starts movement of the sheet bundle SB by the bundle discharging guide 34.

In S216, the CPU 401 discriminates whether or not the sheet bundle SB is discharged onto the lower discharging tray 37 (whether or not the discharge is completed). In the case where the CPU 401 discriminated in S216 that the discharge of the sheet bundle SB onto the lower discharging tray 37 is not completed, the CPU 401 returns the process to S216, and in the case where the CPU 401 discriminated in S216 that the discharge is completed, the CPU 401 causes the process to go to S217. In S217, the CPU 401 stops rotation of the bundle discharging roller pair 36 and raises the upper roller 36*a*, so that the bundle discharging roller pair 36 is spaced (separated) again from each other. In S218, the CPU 401 discriminates whether or not feeding of all the sheets is ended. In the case where the CPU 401 discriminated in S218 that the sheets to be fed to the binding processing portion 4A remain, the process is returned to S203, and then the above-described processes are repeated. In the case where the CPU 401 discriminated in S218 that all the sheets to be fed to the binding processing portion 4A are discharged to the lower discharging tray 37, the CPU 401 ends the process.

As described above, depending on the length of the sheet, the receiving position of the bundle discharging roller pair 36 is selected. Thus, by decreasing the sheet feeding distance of the sheet by the rollers, the degree of the oblique movement of the sheet due to the sheet feeding by the rollers can be reduced. Further, by reducing the degree of the oblique movement, an alignment state of the sheets stacked on the discharging tray can be improved.

As described above, according to the embodiment 1, the degree of the oblique movement of the fed sheets is reduced, so that it is possible to improve the alignment state of the recording materials stacked on the discharging tray.

Embodiment 2

An embodiment 2 will be described principally based on a difference from the embodiment 1. In the embodiment 1, in order to reduce the degree of the oblique movement of the sheet by the bundle discharging roller pair 36 during the sheet feeding, the example in which the sheet feeding distance by the bundle discharging roller pair 36 is decreased depending on the sheet length was described. In the case where the sheet feeding distance by the bundle discharging roller pair 36 is decreased, the sheet feeding distance by the bundle discharging guide 34 is increased. For this reason, the necessary waiting time between adjacent sheets (hereinafter, referred to as a sheet bundle) is increased, so that a time in which all the plurality of sheets are stacked on the discharging tray is increased in some instances. That is, there is a case that productivity lowers. Therefore, in the embodiment 2, an example in which an object thereof is such that a degree of a lowering in productivity in the case where a plurality of sheet bundles are continuously discharged is reduced or such that the degree of the oblique movement of the sheet due to the sheet feeding by the rollers is reduced without lowering the productivity will be described. Also, in the embodiment 2, the constitution described with reference to FIGS. 1 to 3 in the embodiment 1 is used. Accordingly, the embodiment 1 is invoked and redundant description in this embodiment will be omitted.

Function Constitution

FIG. 11 is a block diagram showing a function constitution of the image forming system 1S. Incidentally, in FIG. 11, principally, only the binding processing portion 4A of the post-processing device 4 and a portion relating to sheet feeding control after the binding processing in the embodiment 2 are extracted and shown, and other portions are omitted from illustration. The finisher controller 400 is constituted by a sheet feeding controller 410, a sheet receiving position selecting portion 511 in the embodiment 2, a contact/separation controller 412, and a post-processing controller 413. As regards constitutions similar to the constitutions of the embodiment 1, the constitutions are represented by the same reference numerals or symbols and will be omitted from description.

Receiving Position Selection

The sheet receiving position selecting portion 511 in the embodiment 2 selects a sheet receiving position of the bundle discharging roller pair 36 on the basis of information of the sheet. Selecting processing of the receiving position based on the sheet information of the sheet receiving position selecting portion 511 will be described using a flowchart shown in part (a) of FIG. 12. The sheet information in the embodiment 2 includes, in addition to the information in the embodiment 1, the number of sheets constituting the sheet bundle. Further, the sheet information in the embodiment 2 includes information on whether or not the sheet bundle is a final sheet bundle, in other words, includes information on the presence or absence of a sheet bundle subsequently fed by the first feeding mechanism. The sheet receiving position selecting portion 511 selects the receiving position on the basis of the information on the presence or absence of the sheet subsequently fed by the first feeding mechanism. Processes similar to the processes described using the flowchart of FIG. 5 in the embodiment 1 will be omitted from description by adding the same step numbers.

In S300, the sheet receiving position selecting portion 511 discriminates whether or not the number of sheets of the sheet bundle subjected to processing by the binding processing portion 4A at one time is less than a sheet number SM (less than a predetermined sheet number). In the case where the sheet receiving position selecting portion 511 discriminated in S300 that the sheet number of the sheet bundle is not less than the sheet number SM, the processing is caused to go to S102, and the sheet receiving position selecting portion 511 selects the receiving position B is S102 and then the processing is ended. In the embodiment 2, as an example, the sheet number SM which is the predetermined sheet number is 10 sheets. In the case where the sheet receiving position selecting portion 511 discriminated in S300 that the sheet number of the sheet bundle is less than the sheet number SB, the processing is caused to go to S301.

In S301, the sheet receiving position selecting portion 511 discriminates whether or not the sheet bundle is a final sheet bundle of the image forming job received from the printer controller 100. In the case where the sheet receiving position selecting portion 511 discriminated in S301 that the sheet bundle is the final sheet bundle, the processing is caused to go to S102, and in S102, the sheet receiving position selecting portion 511 selects the receiving position B and then the processing is ended. That is, in the case where there is no sheet to be fed by the first feeding mechanism after the sheets are fed by the first feeding mechanism, it can also be said that the sheet receiving position selecting portion 511 selects the receiving position B. In the case where the sheet receiving position selecting portion 511 discriminated in S301 that the sheet bundle is not the final sheet bundle, the processing is caused to go to S101, and in S101, the sheet receiving position selecting portion 511 selects the receiving position A and then the processing is ended. That is, in the case where the sheet number is less than the predetermined sheet number and there is a sheet to be subsequently fed by the first feeding mechanism, it can also be said that the sheet receiving position selecting portion 511 selects the receiving position A.

As regards the operation in which the sheets are aligned in the binding processing portion 4A and in which the sheet bundle is bound by the stapler 51 and then is discharged onto the lower discharging tray 37, the operation is similar to the operation described with reference to FIGS. 6 to 9 in the embodiment 1, and therefore, will be omitted from redundant description in the embodiment 2 by invoking the embodiment 1.

Control Sequence of Binding Processing Operation and Sheet Discharging Operation A control sequence of bind processing (operation) and sheet discharging (operation) will be described using a flowchart of FIG. 13. Processes similar to the processes described using the flowchart of FIG. 10 in the embodiment 1 will be omitted from description thereof by adding the same step numbers (S201 to S218). In S400, on the basis of sheet information (for example, the sheet number of the sheet bundle, information on whether or not the sheet bundle is the final sheet bundle) of the image forming job received from the printer controller 100, the CPU 401 causes the sheet receiving position selecting portion 511 to select the receiving position of the bundle discharging roller pair 36. A selecting method is as described above using the flowchart of part (a) of FIG. 12. The processes S201 and later are similar to those in the embodiment 1, and therefore will be omitted from description.

As described above, in the embodiment 2, the example in which the receiving position is selected on the basis of the number of sheets of the sheet bundle in the binding processing portion 4A and the sheet information on whether or not the sheet bundle is the final sheet bundle was described. As described above using the table 1, when the receiving position B is selected for the sheets with the same size, compared with the case of the receiving position A, the sheet feeding distance by the bundle discharging guide 34 is increased. For that reason, in the case where the plurality of sheet bundles are continuously discharged, a necessary wait time between adjacent sheet bundles is increased, so that a time in which all the plurality of sheet bundles are stacked on the lower discharging tray 37 is increased. Then, the sheet receiving position selecting portion 511 selects the sheet receiving position on the basis of the number of the sheets of the sheet bundles. In an example of the embodiment 2, only in the case where the sheet number of the sheet bundles is not less than the set sheet number SM, the sheet feeding distance by the bundle discharging roller pair 36 is decreased in order to reduce a degree of the slip or the like.

In the case where the sheet number of the sheet bundles is large, compared with the case where the sheet number of the sheet bundles is small, the influence of an increasing time per(one) sheet relative to the increase in necessary wait time between adjacent sheet bundles becomes small. Therefore, an increase in time until all the sheet bundles in various sheet numbers in the image forming job are stacked on the lower discharging tray 37 can be reduced. Further, in the case where the sheet bundle is the final sheet bundle, in order to receive the subsequent sheet, there is no need to move the bundle discharging guide 34 to the waiting position. Therefore, the sheet receiving position is selected depending on the information on whether or not the sheet bundle is the final sheet bundle. Therefore, the sheet feeding distance by the bundle discharging roller pair 36 is decreased with no increase in time in which the sheet bundles are stacked on the lower discharging tray 37, the degree of the oblique movement of the sheet due to the sheet feeding by the rollers can be reduced. Further, by reducing the degree of the oblique movement, an alignment state of the sheets stacked on the lower discharging tray 37 can be improved.

As described above, according to the embodiment 2, the degree of the oblique movement of the fed sheets is reduced, so that it is possible to improve the alignment state of the recording materials stacked on the discharging tray.

Other Embodiments

Incidentally, as the operation of the binding processing portion 4A in the above-described embodiments, i.e., as an operation including the aligning operation by the aligning portion and the binding operation by the stapler, control in which the sheet receiving position is selected by the bundle discharging roller pair 36 was carried out. However, the present invention is not limited to these constitutions and control. For example, as a constitution in which there is no longitudinal alignment roller, a constitution in which the sheet is fed to the longitudinal alignment reference plate 39 by falling due to a self-weight of the sheet may also be employed. Similarly, the present invention is also applicable to a constitution in which the stapler is not provided or to discharge of the sheet bundle in an image forming job in which the binding operation is not performed. Further, the present invention can be applied to an operation such that a sheet bundle for which the lateral alignment operation is performed and a sheet bundle for which the lateral alignment operation is not performed are alternately discharged onto the discharging tray. In the case of these operation and control, a formula obtained by subtracting the longitudinal alignment operation time, the lateral alignment operation time, and the binding operation time from the above-described formulas (4) and (5) depending on contents of the operation performed by the binding processing portion 4A may be used.

Further, although the operation for feeding the sheet bundle was described, an operation for feeding a single sheet, not the sheet bundle may be performed. The sheet receiving position is selected for single sheet feeding, and the single sheet is fed by the bundle discharging guide 34 and is received by the bundle discharging roller pair 36, so that the above-described effect can also be obtained.

Further, although an operation example in which the sheet receiving position of the bundle discharging roller pair 36 is controlled by controlling the movement distances (LA, LB) of the bundle discharging guide 34 from the waiting position of the bundle discharging guide 34 was described, the present invention is not limited to this operation. For example, an operation in which a sheet sensor for detecting the presence or absence of the sheet is provided in the neighborhood of the bundle discharging roller pair 36 and in which the sheet receiving position of the bundle discharging roller pair 36 is controlled by controlling an elapsed time from detection of the sheet by the sheet sensor, a rotation amount of the guide driving motor M10, and the like may also be performed.

Receiving Position Selection

Further, the selecting process of the receiving position based on the sheet information described using the flowcharts of FIG. 5 and part (a) of FIG. 12 is not limited to the processes by these flowcharts.

A process in which the process S100 in the flowchart of FIG. 5 in the embodiment 1 and the processes S300 and S301 in the flowchart of part (a) of FIG. 12 in the embodiment 2 are combined with each other may be employed. As an example, a flowchart of part (b) of FIG. 12 is shown. In the flowchart of part (b) of FIG. 12, respective processes have already been described in the embodiments 1 and 2, and therefore, the same processes are represented by the same step numbers and will be omitted from redundant description.

As described above, also, in other embodiments, the degree of the oblique movement of the fed recording materials is reduced, so that the alignment state of the recording materials stacked on the discharging tray can be improved.

According to the present invention, the degree of the oblique movement of the fed recording materials is reduced, and thus it is possible to improve the alignment state of the recording materials stacked on the discharging tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-024515 filed on Feb. 21, 2022, which is hereby incorporated by reference herein in its entirety.

What is claimed is:

1. A sheet processing device comprising:

a stacking member configured to stack a sheet;

a discharging member configured to discharge the sheet stacked on the stacking member;

a discharging tray on which the sheet discharged by the discharging member is stacked;

a pushing-out member configured to push out the sheet from the stacking member toward the discharging member by being moved in a pushing-out direction; and a controller configured to select, on the basis of information of the sheet stacked on the stacking member, whether to move the pushing-out member to which position of a first position and a second position positioned on a side downstream of the first position with respect to the pushing-out direction, wherein the controller is configured to select either the first position or the second position before sheets are stacked on the stacking member, wherein the stacking member comprises a guide, wherein the discharging member comprises a roller pair, wherein the pushing-out member comprises a guide, and wherein the controller comprises a processor or the controller comprises circuitry.

2. A sheet processing device according to claim 1, wherein the information of the sheet includes a length of the sheet with respect to a pushing-out direction, and wherein the controller selects the position on the basis of the length of the sheet with respect to the pushing-out direction.

3. A sheet processing device according to claim 2, wherein the controller selects the first position in a case that the length of the sheet with respect to the pushing-out direction is less than a predetermined length and selects the second position in a case that the length of the sheet with respect to the pushing-out direction is not less than the predetermined length.

4. A sheet processing device according to claim 1, wherein the information of the sheet includes a number of sheets, and wherein the controller selects the position on the basis of the number of sheets.

5. A sheet processing device according to claim 4, wherein the controller selects the second position in a case that the number of sheets is more than a predetermined number of sheets.

6. A sheet processing device according to claim 5, wherein the information of the sheet includes information of presence or absence of the sheet subsequently fed by the pushing-out member, and wherein the controller selects the position on the basis of the information of presence or absence of the sheet subsequently fed by the pushing-out member.

7. A sheet processing device according to claim 6, wherein the controller selects the second position in a case that there is no sheet fed by the pushing-out member after the sheet is fed by the pushing-out member.

8. A sheet processing device according to claim 7, wherein the controller selects the first position in a case that the number of sheets is less than the predetermined number of sheets and there is a sheet subsequently fed by the pushing-out member.

9. An image forming system comprising:

an apparatus configured to form an image on a sheet; and a sheet processing device according to claim 1, wherein the sheet processing device receives the sheet from the apparatus and subjects the received sheet to predetermined processing.

10. An image forming system according to claim 9, wherein the predetermined processing includes at least one of longitudinal alignment processing for aligning end portions of a plurality of sheets with respect to the pushing-out direction, lateral alignment processing for aligning end portions of the plurality of sheets with respect to a direction perpendicular to the pushing-out direction, and binding processing for binding the plurality of sheets.

* * * * *